US005701871A

United States Patent [19]

Munakata et al.

[11] Patent Number: 5,701,871

[45] Date of Patent: Dec. 30, 1997

[54] FUEL SUPPLY CONTROL SYSTEM FOR INTERNAL COMBUSTION ENGINES

[75] Inventors: Hiroki Munakata; Yoichi Nishimura; Hiroshi Kitagawa; Shusuke Akazaki, all of Wako, Japan

[73] Assignee: Honda Giken Kogyo Kabushiki Kaisha, Tokyo, Japan

[21] Appl. No.: 575,070

[22] Filed: Dec. 19, 1995

[30] Foreign Application Priority Data

Dec. 20, 1994 [JP] Japan ..... 6-335048
Feb. 24, 1995 [JP] Japan ..... 7-061782

[51] Int. Cl.[6] ..... F02D 41/06; F02D 41/14

[52] U.S. Cl. ..... 123/491; 123/480; 123/674

[58] Field of Search ..... 123/491

[56] References Cited

U.S. PATENT DOCUMENTS 5,353,768 10/1994 Messih et al. ..... 123/491
5,492,101 2/1996 Saito et al. ..... 123/491
5,542,393 8/1996 Katoh et al. ..... 123/491
5,572,978 11/1996 Ogawa ..... 123/491

FOREIGN PATENT DOCUMENTS 63-38637 2/1988 Japan .
3-189344 8/1991 Japan .

*Primary Examiner*—Andrew M. Dolinar
*Attorney, Agent, or Firm*—Nikaido Marmelstein Murray & Oram LLP

[57] ABSTRACT

A fuel supply control system for an internal combustion engine calculates a basic amount of fuel to be supplied to the engine, based on the rotational speed of the engine and load on the engine. An amount of fuel adhering to the inner wall surface of the intake passage of the engine is estimated to calculate an adherent fuel-dependent correction amount. An amount of fuel carried off from the inner wall surface of the intake passage into at least one combustion chamber of the engine is estimated to calculate a carried-off fuel-dependent correction amount. The basic amount of fuel is corrected such that the air-fuel ratio of a mixture supplied to the engine becomes equal to a desired air-fuel ratio determined depending on operating conditions of the engine to obtain a corrected basic fuel amount, and at the same time the corrected basic fuel amount is corrected by the use of the adherent fuel-dependent correction amount and the carried-off fuel-dependent correction amount to calculate an amount of fuel to be supplied to the engine. At least one of the adherent fuel-dependent correction amount and the carried-off fuel-dependent correction amount is corrected according to the desired air-fuel ratio.

5 Claims, 14 Drawing Sheets

FUEL SUPPLY CONTROL SYSTEM FOR INTERNAL COMBUSTION ENGINES

BACKGROUND OF THE INVENTION

1. Field of the Invention

This invention relates to a fuel supply control system for internal combustion engines, and more particularly to a fuel supply control system which determines the amount of fuel injected into an intake pipe of an internal combustion engine in a manner compensating for an amount of fuel adhering to the inner wall surface of the intake pipe.

2. Prior Art

Most of fuel injected by a fuel injection valve into an intake pipe of an internal combustion engine is directly supplied to a combustion chamber of the engine, but part of the injected fuel adheres to the inner wall surface of the intake pipe. A fuel supply control system is conventionally known which performs adherent fuel-dependent correction of the fuel supply, i.e. estimates an amount of fuel adhering to the inner wall surface of the intake pipe (adherent fuel amount) and an amount of fuel carried off from the inner wall surface of the intake pipe (carried-off fuel amount) due to evaporation, and determines an amount of fuel to be supplied by injection by taking these estimated amounts of fuel into account.

However, it is difficult to accurately estimate the adherent fuel amount during the start or cranking of the engine. Therefore, a fuel supply control system which inhibits the adherent fuel-dependent correction of the fuel injection amount during the start of the engine and a fuel supply control system which inhibits the adherent fuel-dependent correction of the fuel injection amount not only during the start of the engine but also when a rate of change in the engine rotational speed exceeds a predetermined value have been also conventionally proposed by Japanese Laid-Open Patent Publication (Kokai) No. 3-189344.

In general, to reduce the amount of unburnt HC contained in feed gas.(exhaust gases just emitted from the combustion chamber of the engine), it is necessary to make the air-fuel ratio of a mixture supplied to the engine as lean as possible within a range in which the mixture can burn. In the conventional fuel supply control systems proposed above, however, the adherent fuel amount and the carried-off fuel amount are determined on the assumption that the air-fuel ratio of the mixture is controlled to a value substantially equal to a stoichiometric air-fuel ratio. Therefore, if the mixture is made lean to such an extent that combustion can barely occur, the adherent fuel amount actually becomes far smaller than the saturation adherent fuel amount (the maximum amount of fuel that can adhere to the inner wall surface of the intake pipe), which makes it impossible to carry out proper adherent fuel-dependent correction of the fuel injection amount.

Conversely, when the air-fuel mixture is enriched during the start of the engine in cold weather or immediately after the start of the engine, the actual adherent fuel amount becomes close to the saturation adherent fuel amount, so that the adherent fuel-dependent correction of the fuel injection amount cannot be properly carried out so long as the adherent fuel amount and the carried-off fuel amount are estimated on the assumption that the air-fuel ratio of the mixture supplied to the engine is substantially equal to the stoichiometric air-fuel ratio.

Further, in the proposed fuel supply control systems, no estimated value of the adherent fuel amount is available when the adherent fuel-dependent correction of the fuel injection amount is started immediately after the start of the engine, which makes it impossible to carry out the adherent fuel-dependent correction with accuracy, and as a result, correction can cause a large change in the amount of fuel supplied to the engine and hence fluctuations in the engine rotational speed.

If the adherent fuel-dependent correction of the fuel injection amount is carried out during the start of the engine in the same manner as the correction after the start of the engine, the following problem arises: When the engine is started in cold weather in particular, a large amount of fuel is expected to adhere to the inner wall surface of the intake pipe. In view of this, according to the prior art the adherent fuel-dependent correction is carried out such that a large amount of fuel is supplied. However, when the engine is started, there are cases where fuel supplied is not burnt, particularly if the amount of fuel remaining unburnt increases due to the correction, which makes the air-fuel ratio of the mixture extremely rich, resulting in degraded startability of the engine.

SUMMARY OF THE INVENTION

It is a first object of the invention to provide a fuel supply control system which is capable of always properly carrying out the adherent fuel-dependent correction of the amount of fuel to be supplied by injection irrespective of the air-fuel ratio of a mixture supplied to the engine, thereby controlling the air-fuel ratio of the mixture actually supplied to the engine with higher accuracy.

It is a second object of the invention to provide a fuel supply control system which is capable of properly carrying out the adherent fuel-dependent correction of the fuel injection amount even during the start of the engine without degrading the startability of the engine, to thereby properly control the amount of fuel actually supplied to the combustion chamber of the engine and at the same time prevent a sudden change in the fuel injection amount when the adherent fuel-dependent correction of the fuel injection amount is started following the start of the engine.

To attain the first object, according to a first aspect of the invention, there is provided a fuel supply control system for an internal combustion engine having an intake passage having an inner wall surface, and at least one combustion chamber, including basic fuel amount-calculating means for calculating a basic amount of fuel to be supplied to the engine, based on rotational speed of the engine and load on the engine, adherent fuel-dependent correction amount-calculating means for estimating an amount of fuel adhering to the inner wall surface of the intake passage to calculate an adherent fuel-dependent correction amount, carried-off fuel-dependent correction amount-calculating means for estimating an amount of fuel carried off from the inner wall surface of the intake passage into the at least one combustion chamber of the engine to calculate a carried-off fuel-dependent correction amount, and fuel supply amount-calculating means for determining a desired air-fuel ratio, based on operating conditions of the engine, and correcting the basic amount of fuel such that an air-fuel ratio of a mixture supplied to the engine becomes equal to the desired air-fuel ratio, the fuel supply amount-calculating means further correcting the corrected basic amount of fuel by the use of the adherent fuel-dependent correction amount and the carried-off fuel-dependent correction amount to calculate an amount of fuel to be supplied to the engine.

The fuel supply control system according to the first aspect of the invention is characterized by comprising correction means for correcting at least one of the adherent fuel-dependent correction amount and the carried-off fuel-dependent correction amount according to the desired air-fuel ratio.

Preferably, the correction means carries out the correction of the at least one of the adherent fuel-dependent correction amount and the carried-off fuel-dependent correction amount when the engine is operating in a condition other than a starting condition.

Also preferably, the desired air-fuel ratio is determined by a correction coefficient set based on operating conditions of the engine.

To attain the first object, according to a second aspect of the invention, there is also provided a fuel supply control system for an internal combustion engine having an intake passage having an inner wall surface, and at least one combustion chamber, including basic fuel amount-calculating means for calculating a basic amount of fuel to be supplied to the engine, based on at least rotational speed of the engine, adherent fuel-dependent correction amount-calculating means for estimating an amount of fuel adhering to the inner wall surface of the intake passage to calculate an adherent fuel-dependent correction amount, carried-off fuel-dependent correction amount-calculating means for estimating an amount of fuel carried off from the inner wall surface of the intake passage into the at least one combustion chamber of the engine to calculate a carried-off fuel-dependent correction amount, and fuel supply amount-calculating means for correcting the basic amount of fuel, based on operating conditions of the engine, the fuel supply amount-calculating means further correcting the corrected basic amount of fuel by the use of the adherent fuel-dependent correction amount and the carried-off fuel-dependent correction amount to calculate an amount of fuel to be supplied to the engine.

The fuel supply control system according to the second aspect of the invention is characterized by comprising correction means for correcting at least one of the adherent fuel-dependent correction amount and the carried-off fuel-dependent correction amount according to a difference between the amount of fuel calculated by the fuel supply amount-calculating means and the basic amount of fuel calculated by the basic fuel amount-calculating means.

Preferably, the correction means carries out the correction of the at least one of the adherent fuel-dependent correction amount and the carried-off fuel-dependent correction amount when the engine is operating in a starting condition.

Also preferably, the correction means carries out of the correction of the at least one of the adherent fuel-dependent correction amount and the carried-off fuel-dependent correction amount both when the engine is operating in a starting condition and when the engine is operating in a condition other than the starting condition.

Advantageously, the fuel supply control system according to the second aspect of the invention includes feedback correction means for detecting an air-fuel ratio of exhaust gases emitted from the engine and correcting the basic amount of fuel calculated by the basic fuel amount-calculating means, based on a difference between the detected air-fuel ratio of the exhaust gases and a desired air-fuel ratio to obtain a corrected basic fuel amount, and wherein the correction means carries out the correction of the at least one of the adherent fuel-dependent correction amount and the carried-off fuel-dependent correction amount according to a difference between the corrected basic fuel amount obtained by the feedback correction means and the amount of fuel calculated by the fuel supply amount-calculating means.

Also advantageously, the fuel supply control system according to the second aspect of the invention includes learning correction means for detecting an air-fuel ratio of exhaust gases emitted from the engine and correcting the basic amount of fuel calculated by the basic fuel amount-calculating means, based on a learned value calculated based on a difference between the detected air-fuel ratio of the exhaust gases and a desired air-fuel ratio to obtain a corrected basic fuel amount, and wherein the correction means carries out the correction of the at least one of the adherent fuel-dependent correction amount and the carried-off fuel-dependent correction amount according to a difference between the corrected basic fuel amount obtained by the learning correction means and the amount of fuel calculated by the fuel supply amount-calculating means.

Preferably, the correction means corrects at least one of the adherent fuel-dependent correction amount and the carried-off fuel-dependent correction amount such that a degree of the correction of the corrected basic amount of fuel by the fuel supply amount-calculating means is smaller as an air-fuel ratio of a mixture supplied to the engine is larger.

More preferably, the correction means minimizes the degree of the correction of the at least one of the adherent fuel-dependent correction amount and the carried-off fuel-dependent correction amount, when the air-fuel ratio of the mixture supplied to the engine is equal to or close to a stoichiometric air-fuel ratio.

The first object of the invention can be also attained by a fuel supply control system for an internal combustion engine having an intake passage having an inner wall surface, and at least one combustion chamber, including basic fuel amount-calculating means for calculating a basic amount of fuel to be supplied to the engine, based on at least rotational speed of the engine, required fuel amount-calculating means for correcting the basic amount of fuel, based on operating conditions of the engine to calculate a required amount of fuel to be supplied to the engine, adherent fuel-dependent correction amount-calculating means for estimating an amount of fuel adhering to the inner wall surface of the intake passage to calculate an adherent fuel-dependent correction amount, carried-off fuel-dependent correction amount-calculating means for estimating an amount of fuel carried off from the inner wall surface of the intake passage into the at least one combustion chamber of the engine to calculate a carried-off fuel-dependent correction amount, and fuel supply amount-calculating means for correcting the required amount of fuel by the use of the adherent fuel-dependent correction amount and the carried-off fuel-dependent correction amount to calculate an amount of fuel to be supplied to the engine, the fuel supply control system being characterized by comprising correction means for correcting at least one of the adherent fuel-dependent correction amount and the carried-off fuel-dependent correction amount according to a difference between the basic amount of fuel calculated by the basic fuel amount-calculating means and the required amount of fuel calculated by the required fuel amount-calculating means.

To attain the second object, according to a third aspect of the invention, there is provided a fuel supply control system for an internal combustion engine having an intake passage having an inner wall surface, at least one fuel injection valve, and at least one combustion chamber, comprising:

required fuel amount-calculating means for calculating a required amount of fuel to be supplied into the at least one combustion chamber of the engine, based on operating conditions of the engine;

starting completion-determining means for determining whether starting of the engine has been completed;

first parameter-calculating means for calculating a first parameter as a parameter representative of fuel adherence characteristics of the inner wall surface of the intake passage, based on operating conditions of the engine before completion of starting of the engine;

second parameter-calculating means for calculating a second parameter as the parameter representative of the fuel adherence characteristics, based on operating conditions of the engine after completion of starting of the engine;

fuel amount-calculating means for calculating a first amount of fuel which is injected by the at least one fuel injection valve and directly drawn into the at least one combustion chamber and a second amount of fuel which is carried off from the inner wall surface of the intake passage into the at least one combustion chamber, based on the first parameter or the second parameter;

fuel injection amount-calculating means for correcting the required amount of fuel calculated by the required fuel amount-calculating means, based on the first amount of fuel and the second amount of fuel to calculate an amount of fuel to be injected by the at least one fuel injection valve; and third parameter-calculating means for calculating a third parameter as the parameter representative of the fuel adherence characteristics for use in the calculation by the fuel amount-calculating means immediately after completion of starting of the engine, based on operating conditions of the engine detected before completion of starting of the engine.

Preferably, the fuel supply control system according to the third aspect of the invention includes transitional control means for progressively shifting the parameter representative of the fuel adherence characteristics from the first parameter calculated by the first parameter-calculating means to the second parameter calculated by the second parameter-calculating means immediately after completion of starting of the engine.

Preferably, the first, second, and third parameters calculated by the first parameter-calculating means, the second parameter-calculating means and the third parameter-calculating means each have a value related to an amount of fuel adhering to the inner wall surface of the intake passage.

More preferably, the first parameter is calculated by the first parameter-calculating means to such a value as cause a smaller degree of the correction of the required amount of fuel by the fuel amount-calculating means than values to which are calculated the second and third parameters by the second parameter-calculating means and the third parameter-calculating means.

The second object of the invention may also be attained by a fuel supply control system for an internal combustion engine having an intake passage having an inner wall surface, at least one fuel injection valve, and at least one combustion chamber, comprising:

required fuel amount-calculating means for calculating a required amount of fuel to be supplied into the at least one combustion chamber of the engine, based on operating conditions of the engine;

starting completion-determining means for determining whether starting of the engine has been completed;

first parameter-calculating means for calculating a first parameter as a parameter representative of fuel adherence characteristics of the inner wall surface of the intake passage, based on operating conditions of the engine before completion of starting of the engine;

second parameter-calculating means for calculating a second parameter as the parameter representative of the fuel adherence characteristics, based on operating conditions of the engine after completion of starting of the engine;

fuel amount-calculating means for calculating a first amount of fuel which is injected by the at least one fuel injection valve and directly drawn into the at least one combustion chamber and a second amount of fuel which is carried off from the inner wall surface of the intake passage into the at least one combustion chamber, based on the first parameter or the second parameter;

fuel injection amount-calculating means for correcting the required amount of fuel calculated by the required fuel amount-calculating means, based on the first amount of fuel and the second amount of fuel to calculate an amount of fuel to be injected by the at least one fuel injection valve;

the first parameter being calculated by the first parameter-calculating means to such a value as cause a smaller degree of the correction of the required amount of fuel by the fuel injection amount-calculating means than a value to which is calculated the second parameter by the second parameter-calculating means.

The above and other objects, features, and advantages of the invention will become more apparent from the following detailed description taken in conjunction with the accompanying drawings.

DETAILED DESCRIPTION

The invention will now be described in detail with reference to the drawings showing embodiments thereof.

Figure 1:
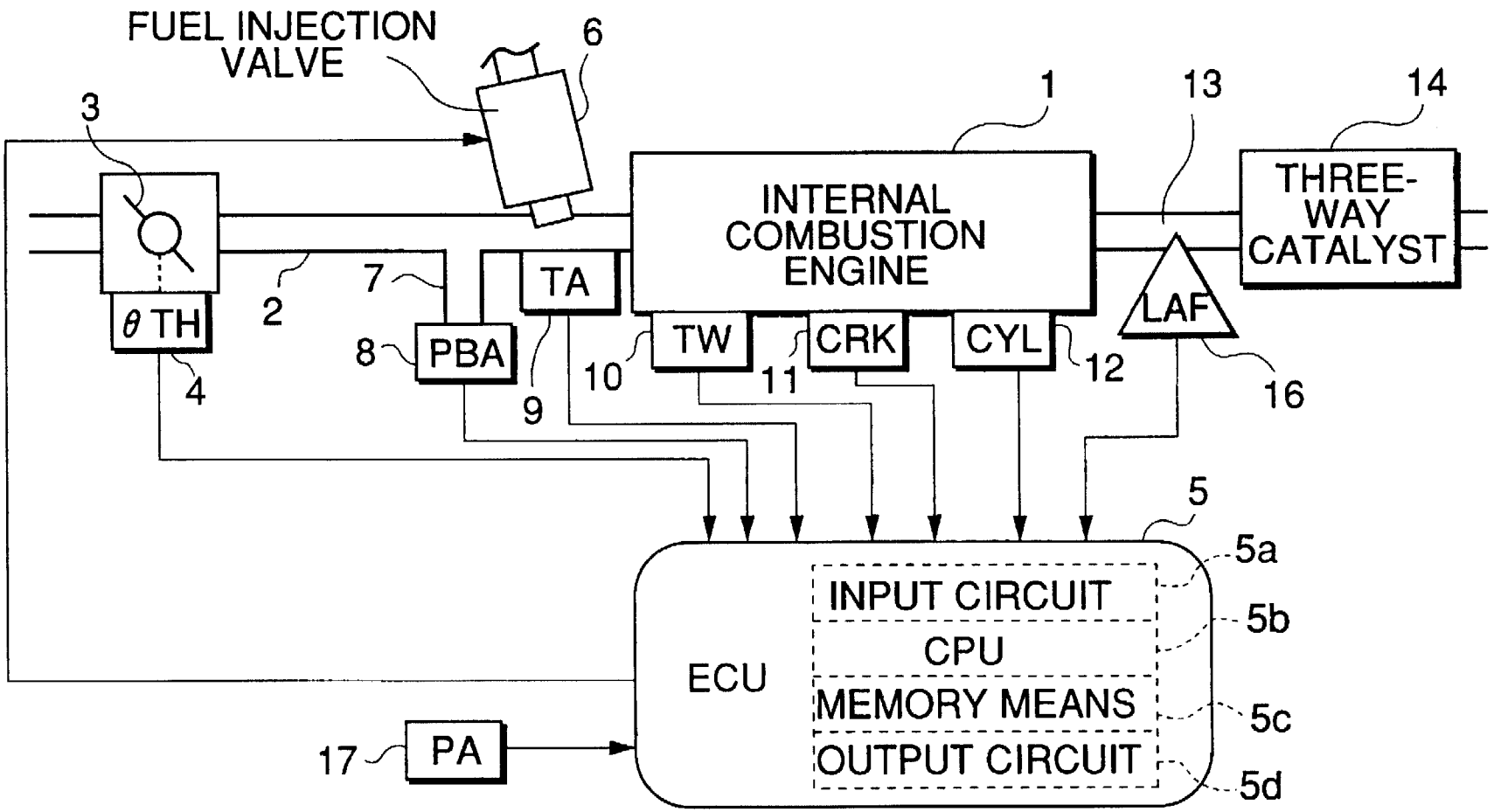
FIG. 1 is a diagram showing the arrangement of an internal combustion engine incorporating a fuel supply control system therefor, according to a first embodiment of the invention.

Referring first to FIG. 1, there is shown the whole arrangement of an internal combustion engine (hereinafter simply referred to as "the engine") and a fuel supply control system therefor, according to a first embodiment of the invention. In the figure, reference numeral 1 designates an internal combustion engine for automotive vehicles. Connected to the cylinder block of the engine 1 is an intake pipe 2 in which is arranged a throttle valve 3. A throttle valve opening (θTH) sensor 4 is connected to the throttle valve 3 for generating an electric signal indicative of the sensed throttle valve opening θTH and supplying the same to an electronic control unit (hereinafter referred to as "the ECU") 5.

Fuel injection valves 6, only one of which is shown, are inserted into the interior of the intake pipe 2 at locations intermediate between the cylinder block of the engine 1 and the throttle valve 3 and slightly upstream of respective intake valves, not shown. The fuel injection valves 6 are connected to a fuel pump, not shown, and electrically connected to the ECU 5 to have their valve opening periods controlled by signals therefrom.

On the other hand, an intake pipe absolute pressure (PBA) sensor 8 is provided in communication with the interior of the intake pipe 2 via a conduit 7 at a location immediately downstream of the throttle valve 3 for supplying an electric signal indicative of the sensed absolute pressure PBA within the intake pipe 2 to the ECU 5. An intake air temperature (TA) sensor 9 is inserted into the intake pipe 2 at a location downstream of the intake pipe absolute pressure sensor 8 for supplying an electric signal indicative of the sensed intake air temperature TA to the ECU 5.

An engine coolant temperature (TW) sensor 10, which may be formed of a thermistor or the like, is mounted in the cylinder block of the engine 1, for supplying an electric signal indicative of the sensed engine coolant temperature TW to the ECU 5.

A crank angle (CRK) sensor 11 and a cylinder-discriminating (CYL) sensor 12 are arranged in facing relation to a camshaft or a crankshaft of the engine 1, neither of which is shown. The CRK sensor 11 generates a CRK signal pulse at each of predetermined crank angle positions whenever the crankshaft rotates through a predetermined angle (e.g. 30 degrees) smaller than half a rotation (180 degrees) of the crankshaft of the engine 1. CRK signal pulses are supplied to the ECU 5, and a TDC signal pulse is generated based on CRK signal pulses. That is, each TDC signal pulse represents a reference crank angle position of each cylinder, and is generated whenever the crankshaft rotates through 180 degrees.

Further, the ECU 5 calculates a CRME value by measuring time intervals between adjacent CRK signal pulses, and adds up CRME values over each time interval between two adjacent TDC signal pulses to obtain an ME value. Then, the engine rotational speed NE is calculated from the reciprocal of the ME value. The CYL sensor 12 generates a pulse (hereinafter referred to as "the CYL signal pulse") at a predetermined crank angle position (e.g. 10 degrees before TDC) of a particular cylinder of the engine assumed before a TDC position corresponding to the start of the intake stroke of the particular cylinder, and the CYL signal pulse being supplied to the ECU 5.

Further, the ECU 5 sets stages of each cycle of each cylinder. More specifically, the ECU 5 sets a #0 crank angle stage corresponding to a CRK signal pulse detected immediately after generation of a TDC signal pulse. Then, the stage number is incremented by 1 whenever one CRK signal pulse is detected thereafter, thereby sequentially setting stages #0 to #5 for each cycle of each cylinder in the case of a four-cylinder engine which generates CRK signal pulses at intervals of 30 degrees.

A three-way catalyst 14 is arranged within an exhaust pipe 13 connected to the cylinder block of the engine 1 for purifying noxious components such as HC, CO, and NOx. An oxygen concentration sensor (hereinafter referred to as "the LAF sensor") 16 is mounted in the exhaust pipe 13 at a location upstream of the three-way catalyst 14, for sensing the concentration of oxygen present in exhaust gases emitted from the engine 1 and supplying an electric signal indicative of the sensed oxygen concentration value to the ECU 5.

Further connected to the ECU 5 is an atmospheric pressure sensor 17 for detecting atmospheric pressure PA and supplying a signal indicative of the sensed atmospheric pressure PA.

The ECU 5 is comprised of an input circuit 5*a* having the functions of shaping the waveforms of input signals from various sensors, shifting the voltage levels of sensor output signals to a predetermined level, converting analog signals from analog-output sensors to digital signals, and so forth, a central processing unit(hereinafter called "the CPU") 5*b*, memory means 5*c* storing various operational programs which are executed by the CPU 5*b*, and for storing results of calculations therefrom, etc., and an output circuit 5*d* which outputs driving signals to the fuel injection valves 6, etc.

Next, description will be made of a manner of calculating the fuel injection period TOUT over which the fuel injection valve 6 is opened, which compensates for the amount of fuel adhering to the inner wall surface of the intake pipe 2 (adherent fuel amount). Parameters used in the control of the fuel injection amount are actually calculated in terms of time periods over which the fuel injection valves 6 are opened (fuel injection periods), but in the present and following embodiments, they are described as fuel injection amounts or fuel amounts, since the fuel injection period of the fuel injection valve 6 corresponds to an amount of fuel.

Figure 2:
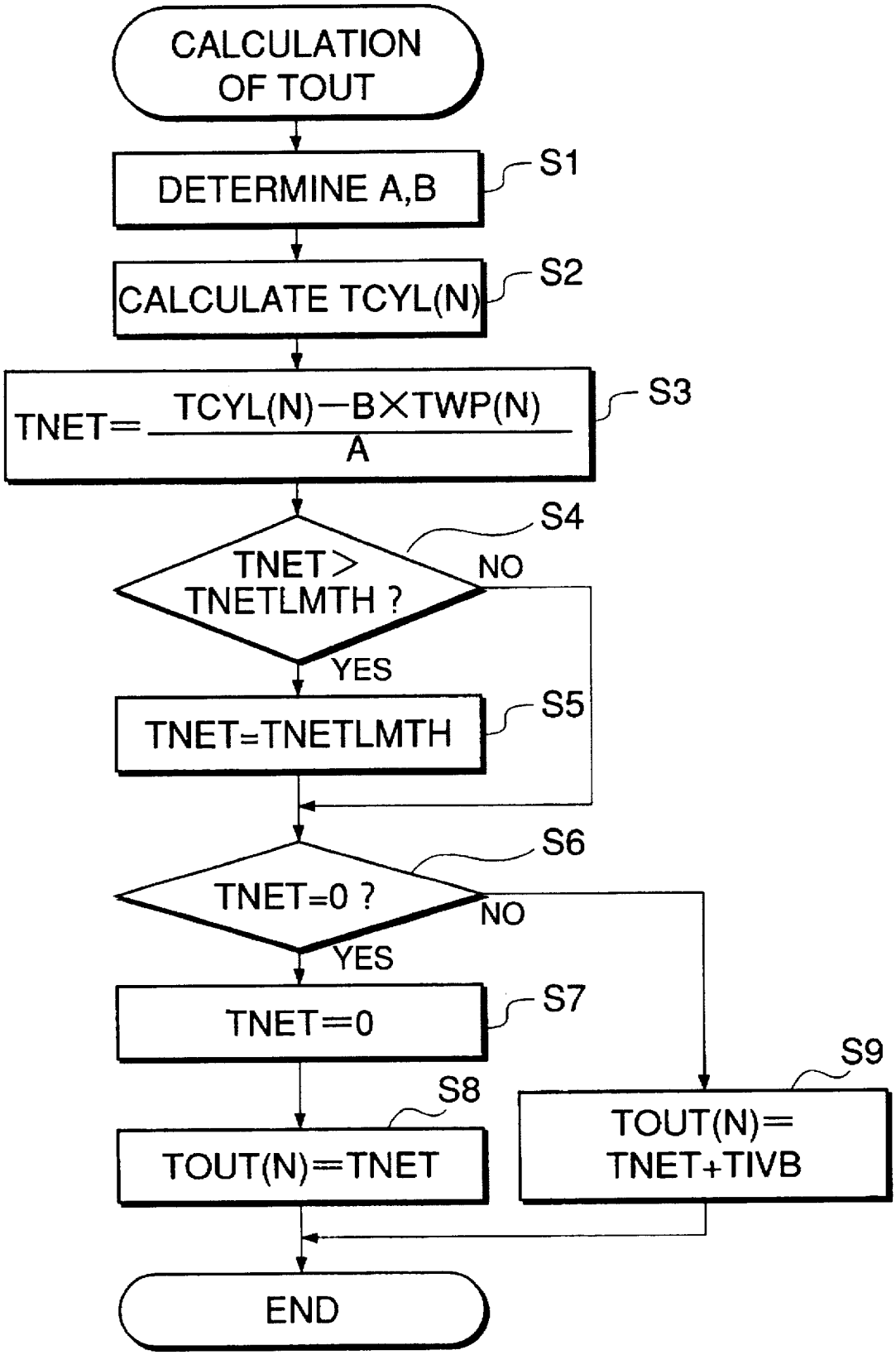
FIG. 2 is a flowchart showing a routine for calculating a fuel injection amount TOUT.

FIG. 2 shows a routine for calculating the fuel injection amount TOUT, which is executed by the CPU of the ECU 5 in synchronism of generation of each TDC signal pulse.

First, at a step S1, a direct supply ratio A and a carry-off ratio B as adherent fuel-dependent correction parameters are calculated. The direct supply ratio A is defined as the ratio of an amount of fuel directly drawn into a combustion chamber of a cylinder in one cycle Of the cylinder to an amount of fuel injected for the cylinder in the same cycle, while the carry-off ratio B as the ratio of an amount of fuel carried off from the inner wall surface of the intake pipe into the combustion chamber of the cylinder due to evaporation and other factors to an amount of fuel adhering to the inner wall surface of the intake pipe. Details of the calculation of the direct supply ratio A and the carry-off ratio B will be described hereinafter with reference to FIG. 4.

At the following step S2, a required fuel amount TCYL (N) is calculated for each cylinder by the use of the following equations (1) and (2), the former being applied when the engine is in a basic mode of the engine (i.e. except when the engine is being started or in the starting mode), while the latter being applied when the engine is in the starting mode:

$$TCYL(N)=TIM\times KTOTAL(N) \quad (1)$$

$$TCYL(N)=TIS\times KTWAF\times KPACR \quad (2)$$

where the suffix (N) represents the number allotted to the cylinder (a parameter with this suffix is calculated cylinder by cylinder). TIM represents a basic fuel amount which is applied when the engine is in the basic mode (except when the engine is in the starting mode) and determined according to the engine rotational speed NE and the intake pipe absolute pressure PBA. KTOTAL represents the product of all correction coefficients which are determined based on engine operating parameters detected by various sensors, such as a desired air-fuel ratio coefficient KCMD which is determined based on operating conditions of the engine and corresponding to a desired air-fuel ratio of the mixture to be supplied to the engine 1, an air-fuel ratio correction coefficient KLAF which is set such that the detected air-fuel ratio becomes equal to the desired air-fuel ratio, and an engine coolant temperature-dependent correction coefficient KTW which is set according to the engine coolant temperature TW.

TIS represents a basic fuel amount which is applied when the engine is in the starting mode, and set according to the engine rotational speed NE. KTWAF represents a correction coefficient which is set according to the engine coolant temperature TW, and KPACR a correction coefficient which is set according to atmospheric pressure PA.

At the following step S3, a net fuel injection amount TNET which is the amount of fuel to be injected in the present loop is calculated by the following equation (3):

$$TNET=(TCYL(N)-B\times TWP(N))/A \quad (3)$$

where A and B represent the direct supply ratio and the carry-off ratio, respectively, TWP(N) represents the adherent fuel amount (estimated value) which is calculated by a subroutine described hereinafter with reference to FIG. 3, and (B×TWP(N)) corresponds to an amount of fuel carried off from the inner wall surface of the intake pipe into the combustion chamber. An amount of fuel corresponding to the amount of fuel carried off from the intake pipe wall need not be newly injected, and hence it is subtracted from the required fuel amount TCYL(N) by the equation (3).

Next, it is determined at a step S4 whether or not the net fuel injection amount TNET is larger than a predetermined upper limit value TNETLMTH. If TNET≦TNETLMTH holds, the program immediately proceeds to a step S6, whereas if TNET>TNETLMTH holds, the net fuel injection amount TNET is set to the predetermined upper limit value TNETLMTH, and then the program proceeds to the step S6. At the step S6, it is determined whether or not the net fuel injection amount TNET assumes a negative value. If TNET≧0 holds, a final fuel injection period TOUT(N) is calculated at a step S9 by the use of the following equation (4), followed by terminating the program:

$$TOUT(N)=TNET+TIVB \quad (4)$$

where TIVB represents an ineffective time period set according to the battery voltage.

If TNET<0 holds at the step S6, the net fuel injection amount TNET is set to "0" at a step S7, and hence the fuel injection amount TOUT(N) is set to "0" at a step S8, followed by terminating the program.

Figure 3:
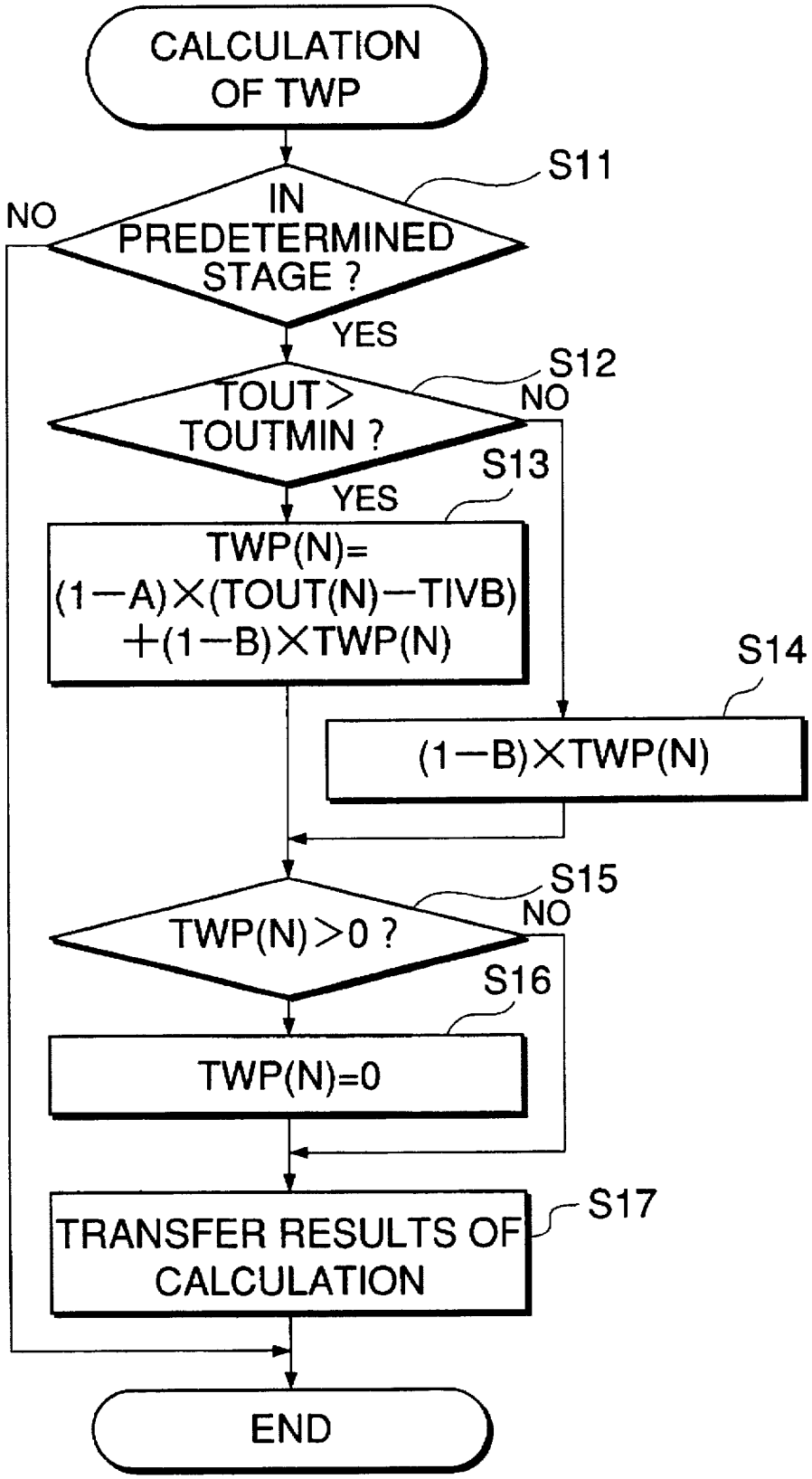
FIG. 3 is a flowchart showing a routine for calculating an amount of fuel adhering to the inner wall surface of an intake pipe of the engine (adherent fuel amount) TWP.

FIG. 3 shows a routine for calculating the adherent fuel amount TWP(N), which is executed by a sub-CPU, not shown, which is different from the CPU described above (main CPU), in synchronism with Generation of each CRK signal pulse. Parameters necessary for this processing are transferred to the sub-CPU from the main CPU.

First, at a step S11, it is determined whether or not the present loop corresponds to a predetermined stage for calculating the adherent fuel amount TWP. If the present loop does not correspond to the predetermined stage, the present program is immediately terminated. The predetermined stage corresponds to a crank angle position of the corresponding cylinder in the vicinity of termination of the intake stroke, i.e. immediately after termination of the fuel injection.

When the present loop corresponds to the predetermined stage, it is determined at a step S12 whether or not the value of the fuel injection amount TOUT of an injection just terminated is larger than a predetermined lower limit value TOUTMIN. If TOUT≦TOUTMIN holds, it is judged that fuel cut is being carried out, and the adherent fuel amount TWP(N) is calculated at a step S14 by the use of the following equation (5), in which is made no addition of a newly attached amount of adherent fuel, since during fuel cut, only part of the adherent fuel is carried off from the intake pipe wall:

$$TWP(N)=(1-B)\times TWP(N) \quad (5)$$

where TWP(N) on the right side represents the immediately preceding value of the adherent fuel amount calculated for the cylinder.

If TOUT>TOUTMIN holds at the step S12, the adherent fuel amount TWP(N) is calculated at a step S13 by the following equation (6):

$$TWP(N)=(1-A)\times(TOUT(N)-TIVB)+(1-B)\times TWP(N) \quad (6)$$

where the first term on the right side represents an amount of fuel newly attached to the inner wall surface of the intake pipe by the injection just carried out, and the second term on the right side is identical to the term on the right side of the equation (5) and represents a remaining portion of the adherent fuel from which a portion of fuel has been carried off.

After execution of the step S13 or S14, it is determined at a step S15 whether or not the calculated adherent fuel amount TWP(N) has a positive value. If TWP(N)>0 holds, the program jumps to a step S17, whereas if TWP(N)≦0 holds, the adherent fuel amount TWP(N) is set to "0" at a step S16, followed by the program proceeding to the step S17.

At the step S17, the calculated TWP(N) value is transferred to the main CPU, followed by terminating the program.

Figure 4:
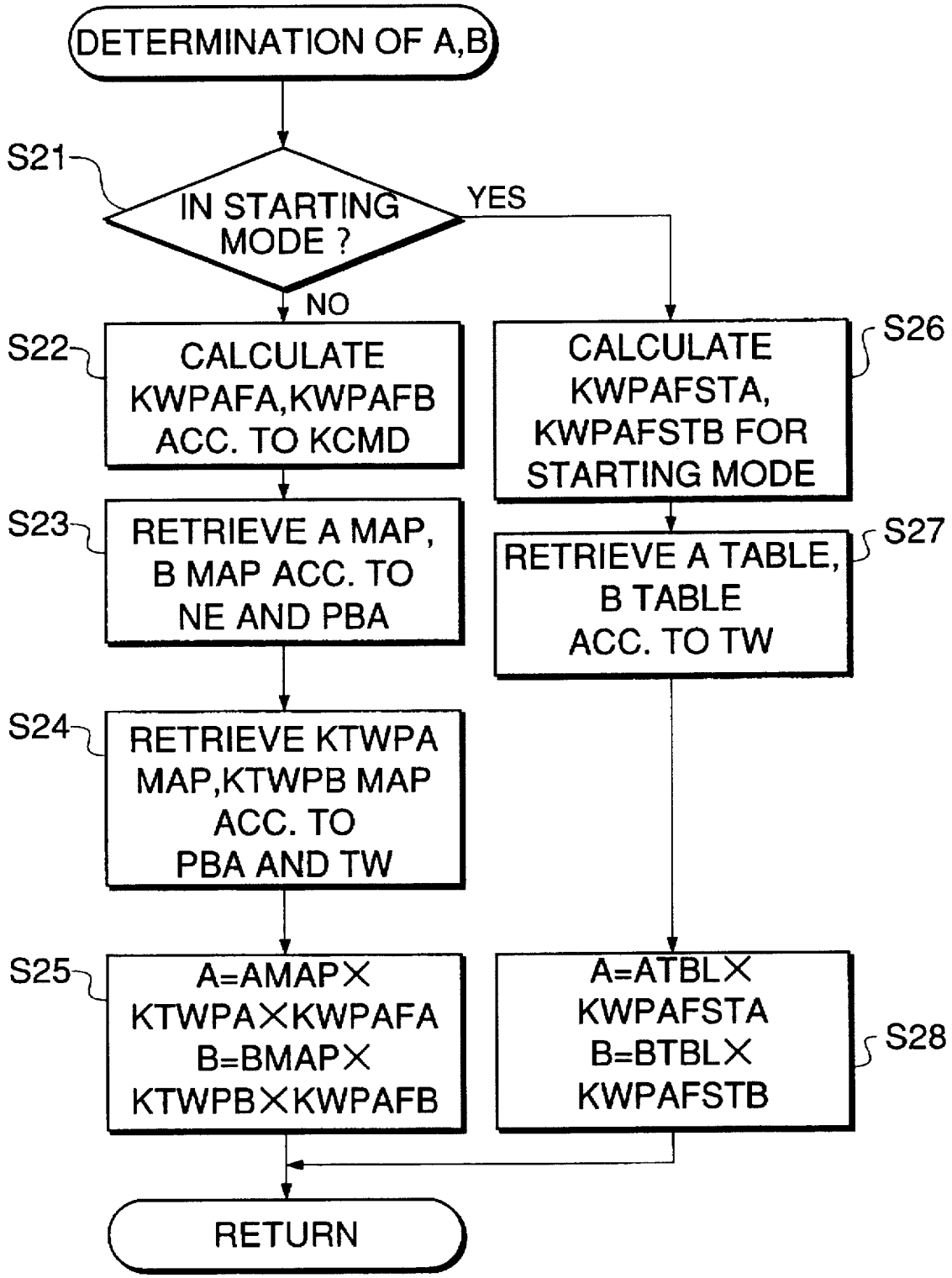
FIG. 4 is a flowchart showing a subroutine for calculating a direct supply ratio A and a carry-off ratio B.

FIG. 4 shows a routine executed at the step S1 of the FIG. 2 routine for calculating the direct supply ratio A and the carry-off ratio B.

First, it is determined at a step S21 whether or not the engine 1 is in the starting mode, i.e. if the engine is being cranked. If the engine is not in the starting mode, the program proceeds to a step S22, wherein a first direct supply ratio-correcting coefficient KWPAFA and a first carry-off ratio-correcting coefficient KWPAFB are calculated according to the desired air fuel ratio coefficient KCMD. The desired air-fuel ratio coefficient KCMD is included in the coefficient product KTOTAL in the equation (1), as mentioned hereinbefore, and set based on operating conditions of the engine to a value corresponding to a desired air-fuel ratio of the mixture supplied to the engine 1. That is, when the desired air-fuel ratio is equal to the stoichiometric air-fuel ratio, the desired air-fuel ratio coefficient KCMD is set to "1.0". When the desired air-fuel ratio is leaner than the stoichiometric air-fuel ratio, the KCMD value is set to a value smaller than "1.0", and when the desired air-fuel ratio is richer than the stoichiometric air-fuel ratio, the KCMD value is set to a value larger than "1.0".

Figure 5:
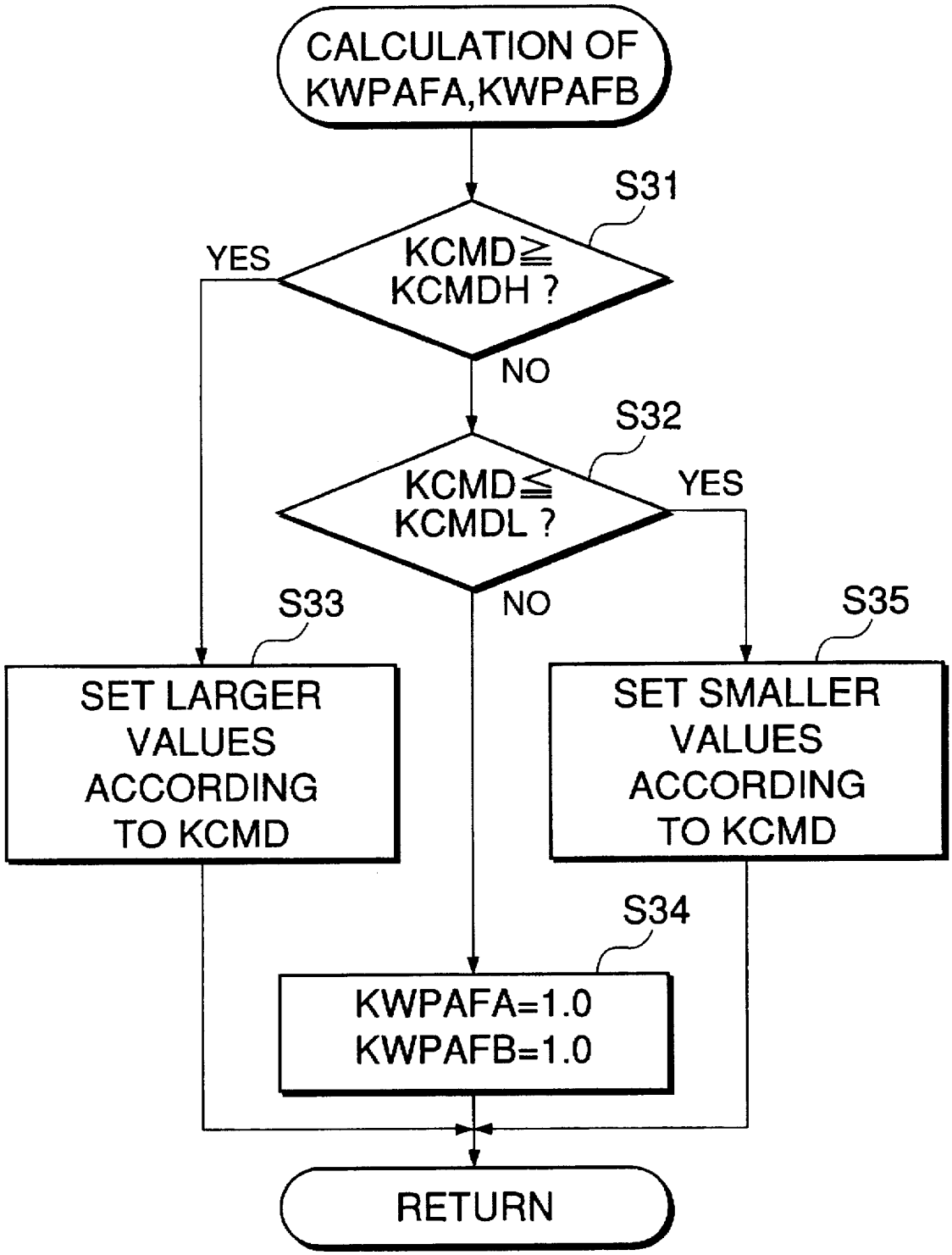
FIG. 5 is a flowchart showing a subroutine for calculating a direct supply ratio correction coefficient KWPAFA and a carry-off ratio correction coefficient KWPAFB.

The calculation of the correction coefficients KWPAFA, KWPAFB at the step S22 is executed e.g. by carrying out a subroutine shown in FIG. 5.

In the figure, it is first determined at a step S31 whether or not the desired air-fuel ratio KCMD is equal to or larger than an upper limit value KCMDH which is larger than "1.0", and at a step S32 whether or not the desired air-fuel ratio KCMD is equal to or smaller than a lower limit value KCMDL which is smaller than "1.0". If KCMDL<KCMD<KCMDH holds, the correction coefficients KWPAFA, KWPAFB are both set to "1.0", i.e. a non-correction value, at a step S34.

Figure 6A:
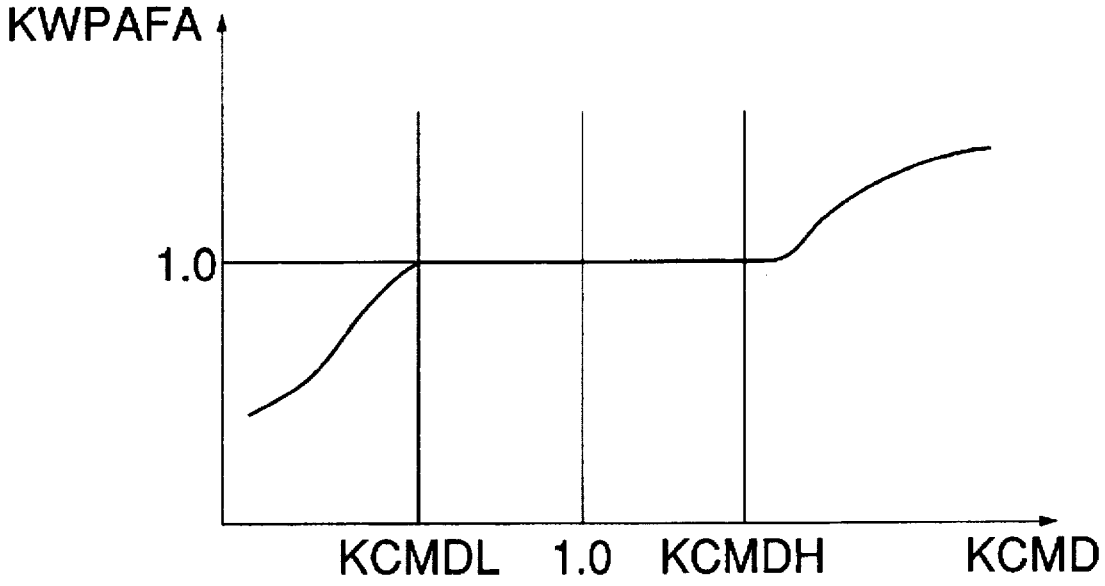
FIG. 6 shows a KWPAFA table for use in determining a direct supply ratio correction coefficient KWPAFA.
FIG. 6B shows a KWPAFB table for use in determining a carry-off ratio correction coefficient KWPAFB.
Figure 6B:
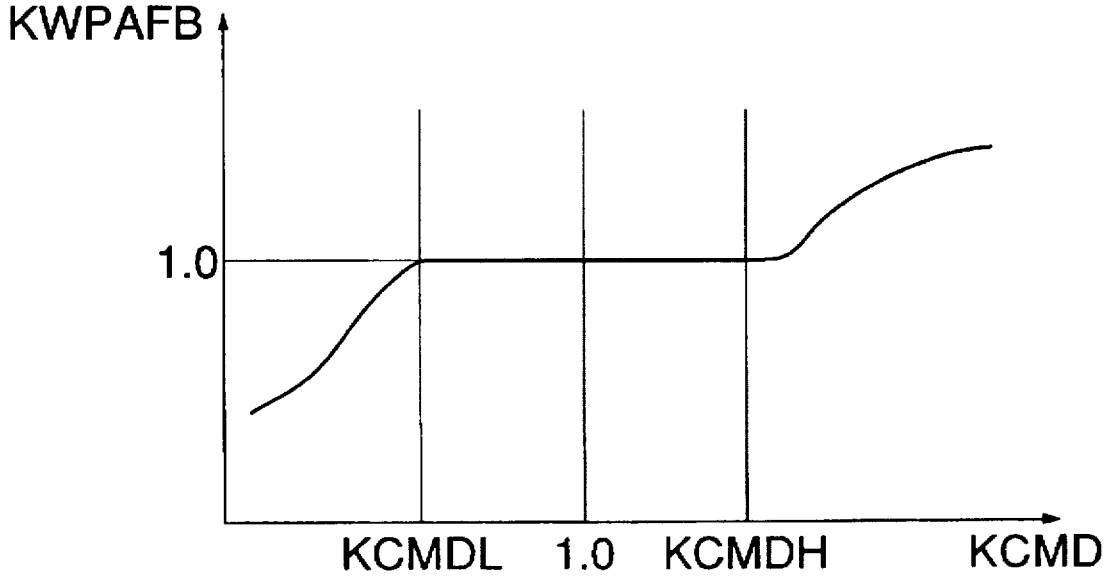

On the other hand, if KCMD≧KCMDH holds, the correction coefficients KWPAFA, KWPAFB are set at a step S33 by retrieving a KWPAFA table and a KWPAFB table which are set e.g. as shown in FIG. 6A and FIG. 6B, respectively, such that the values of the correction coefficients KWPAFA and KWPAFB increase as the desired air-fuel ratio coefficient KCMD increases, i.e. as the desired air-fuel ratio is richer.

If KCMD≦KCMDL holds, the correction coefficients KWPAFA and KWPAFB are set to smaller values as the desired air-fuel ratio is leaner by retrieving the KWPAFA and KWPAFB tables at a step S35.

By thus setting the correction coefficients KWPAFA, KWPAFB, the direct supply ratio A and the carry-off ratio B can be set to proper values even if the desired air-fuel ratio is set to an extremely rich value or an extremely lean value with respect to the stoichiometric air-fuel ratio, to thereby carry out accurate adherent fuel-dependent correction irrespective of the desired air-fuel ratio.

The air-fuel ratio of the mixture supplied to the engine 1 is controlled in a feedback manner responsive to the output from the LAF sensor 16 such that it becomes equal to the desired air-fuel ratio, and accordingly the correction coefficients KWPAFA, KWPAFB are set to values corresponding to the air-fuel ratio of the mixture supplied to the engine.

Referring again to FIG. 4, at a step S23, a map value AMAP of the direct supply ratio A and a map value BMAP of the carry-off ratio B are determined by retrieving an A map and a B map according to the engine rotational speed NE and the intake pipe absolute pressure PBA, and by carrying out interpolation of the retrieved map values, if necessary. The A map and the B map contain map values suitable for a warmed-up condition of the engine 1.

Next, a second direct supply ratio correction coefficient KTWPA and a second carry-off ratio correction coefficient KTWPB are determined at a step S24 by retrieving a KTWPA map and a KTWPB map according to the intake pipe absolute pressure PBA and the engine coolant temperature TW, and by carrying out interpolation of the retrieved map values, if necessary.

At the following step S25, the direct supply ratio A and the carry-off ratio B are calculated by the use of the following equations:

$$A=AMAP\times KTWPA\times KWPAFA \quad (7)$$

$$B=BMAP\times KTWPB\times KWPAFB \quad (8)$$

Figure 7:
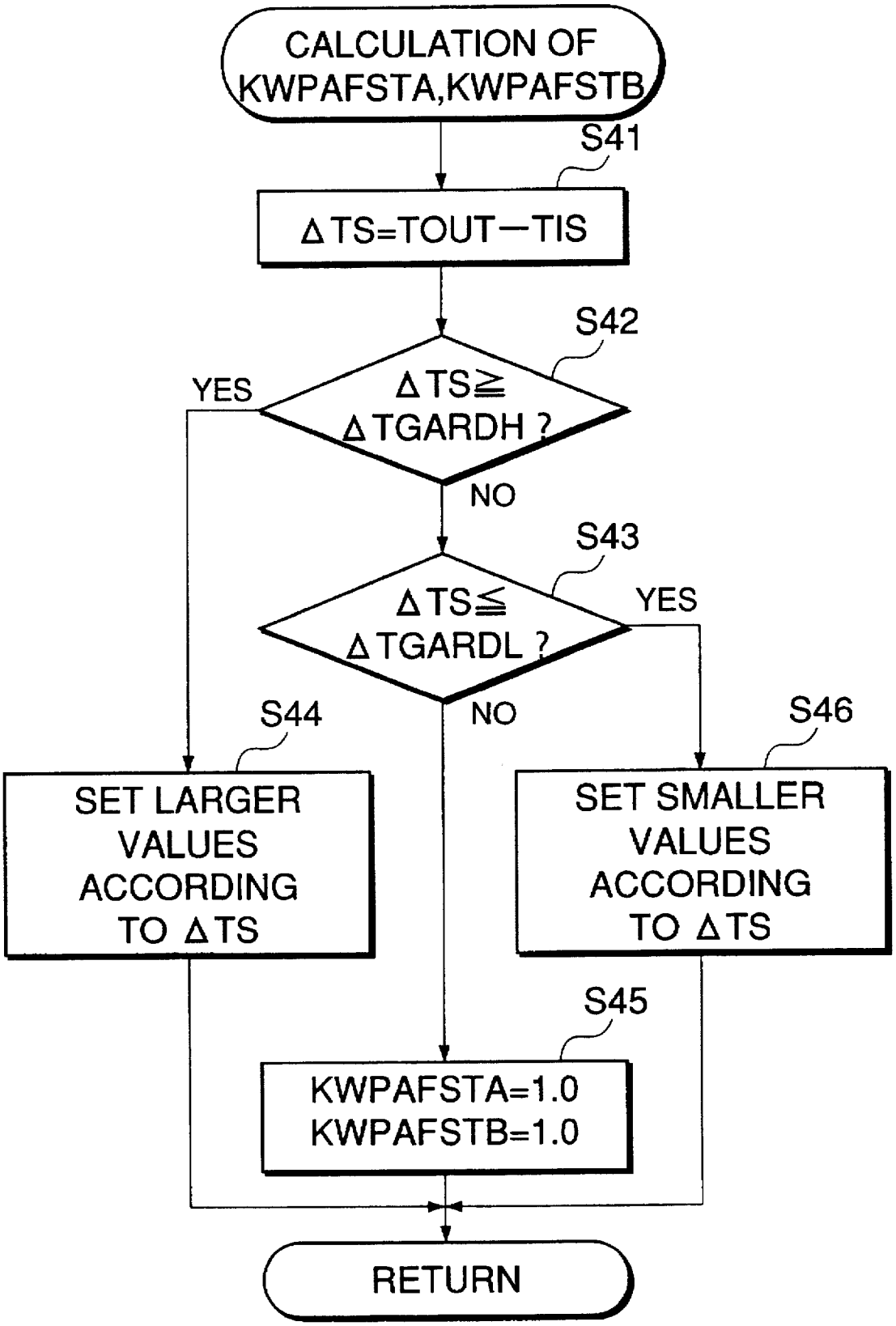
FIG. 7 is a flowchart showing a subroutine for calculating a direct supply ratio correction coefficient KWPAFSTA for the starting mode of the engine and a carry-off ratio correction coefficient KWPAFSTB for the starting mode of the engine.

On the other hand, if it is determined at the step S21 that the engine is in the starting mode, a direct supply ratio correction coefficient KWPAFSTA and a carry-off ratio correction coefficient KWPAFSTB both suitable for the starting mode of the engine are calculated at a step S26 by executing a subroutine shown in FIG. 7.

In the FIG. 7 subroutine, at a step S41, the difference ΔTS (=TOUT−TIS) between the fuel injection amount TOUT (ultimate value) and the basic fuel injection amount TIS which is applied when the engine is in the starting mode is calculated. Then, it is determined at a step S42 whether or not the difference ΔTS is equal to or larger than a predetermined positive value ΔTGARDH, and at a step S43 whether or not the difference ΔTS is equal to or smaller than a predetermined negative value ΔTGARDL. If ΔTGARDL<ΔTS<ΔTGARDH holds, the correction coefficients KWPAFSTA and KWPAFSTB are both set to "1.0", i.e. the non-correction value at a step S45.

Figure 8A:
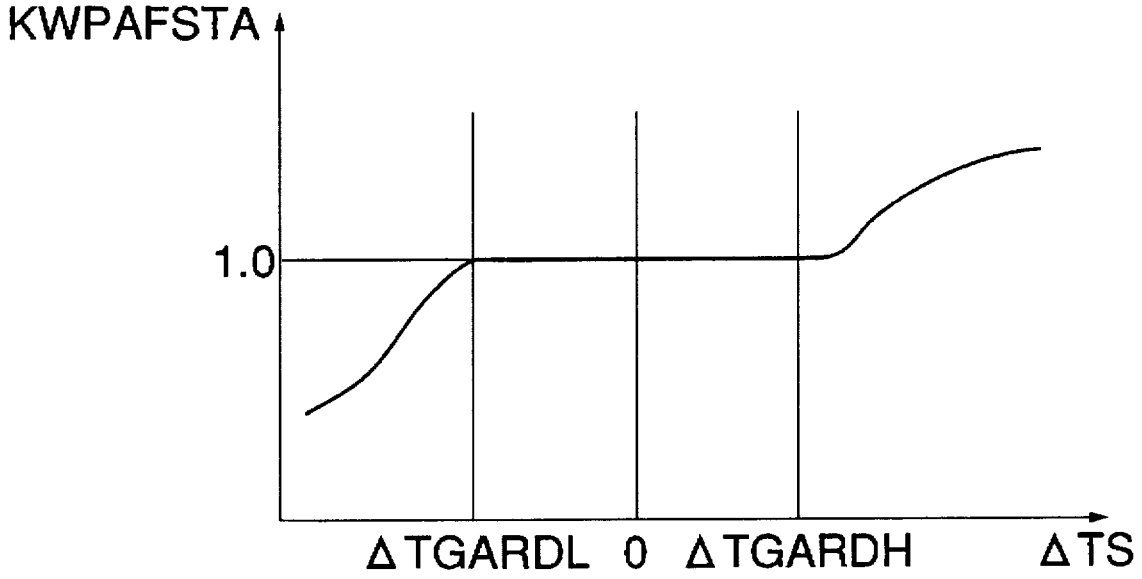
FIG. 8A shows a KWPAFSTA table for use in determining the direct supply ratio correction coefficient KWPAFSTA for the starting mode of the engine.
Figure 8B:
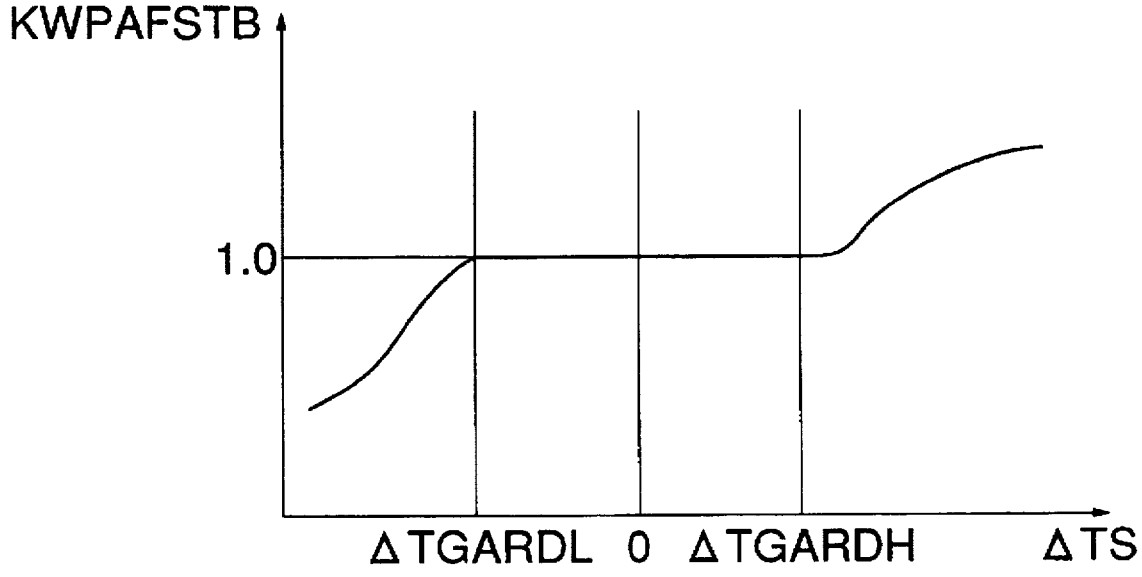
FIG. 8B shows a KWPAFSTB table for use in determining the carry-off ratio correction coefficient KWPAFSTB for the starting mode of the engine.

Further, if ΔTS≧ΔTGARDH holds, the correction coefficients KWPAFSTA, KWPASTFB are set at a step S44 by retrieving a KWPAFSTA table and a KWPAFSTB table which are set e.g. as shown in FIG. 8A and FIG. 8B, respectively, such that the values of the coefficients KWPAFSTA and KWPAFSTB increase as the ΔTS value increases, i.e. the air-fuel ratio of the mixture supplied when the engine is started is richer.

If ΔTS≦ΔTGARDL holds, the correction coefficients KWPAFSTA and KWPAFSTB are set to smaller values as the ΔTS value decreases, i.e. the air-fuel ratio during the start of the engine is leaner at a step S46 by retrieving the KWPAFSTA and KWPAFSTB tables.

By thus setting the correction coefficients KWPAFSTA, KWPAFSTB, the direct supply ratio A and the carry-off ratio B can be set to proper values even if the air-fuel ratio of the mixture is set to an extremely rich value or an extremely lean value with respect to the stoichiometric air-fuel ratio, to thereby carry out accurate adherent fuel-dependent correction irrespective of the air-fuel ratio of the mixture supplied to the engine.

Referring again to FIG. 4, at the step S27, a table value ATBL of the direct supply ratio A and a table value BTBL of the carry-off ratio B are determined by retrieving an A table and a B table according to the engine coolant temperature TW, and by carrying out interpolation of the retrieved table values, if necessary.

Next, the direct supply ratio A and the carry-off ratio B are calculated by the use of the following equations (9) and (10):

$$A=ATBL\times KTWPAFSTA \quad (9)$$

$$B=BTBL\times KTWPAFSTB \quad (10)$$

As described above, according to the present embodiment, in carrying out the adherent fuel-dependent correction of the fuel injection amount, when the engine is in a normal operating condition or in the basic mode, the direct supply ratio A and the carry-off ratio B as adherent fuel-dependent correction parameters are set to larger values (closer to "1.0") as the desired air-fuel ratio is richer (i.e. as the KCMD value is larger), thereby reducing the degree of the adherent fuel-dependent correction, whereas when the engine is in the staring mode, the direct supply ratio A and the carry-off ratio B are set to larger values as the difference ΔTS between the fuel injection amount TOUT as the ultimate value after the correction and the basic fuel injection amount TIS is larger, thereby reducing the degree of the adherent fuel-dependent correction. This makes it possible to accurately carry out the adherent fuel-dependent correction of the fuel injection amount over a wider range of the air-fuel ratio of the mixture supplied to the engine.

Next, a second embodiment of the invention will be described with reference to FIG. 9.

This embodiment is distinguished from the first embodiment described above in that the LAF sensor 16 appearing in FIG. 1 is replaced by an O2 sensor. The O2 sensor has an output characteristic that its output voltage drastically changes as the air-fuel ratio of the mixture changes across the stoichiometric air-fuel ratio, such that it assumes a high level when the air-fuel ratio of the mixture is on a richer side than the stoichiometric air-fuel ratio and a low level when the air-fuel ratio is on a leaner side than the stoichiometric air-.fuel ratio. To comply with the sensor output characteristic, the desired air-fuel ratio coefficient KCMD and the air-fuel ratio correction coefficient KLAF included in the coefficient product KTOTAL in the equation (1) for calculating the required fuel amount TCYL are replaced by an air-fuel ratio correction coefficient KO2 which is set depending on whether the output from the O2 sensor is on a leaner side or a richer side with respect to a reference value corresponding to the stoichiometric air-fuel ratio such that the air-fuel ratio of the mixture becomes equal to the stoichiometric air-fuel ratio.

Figure 9:
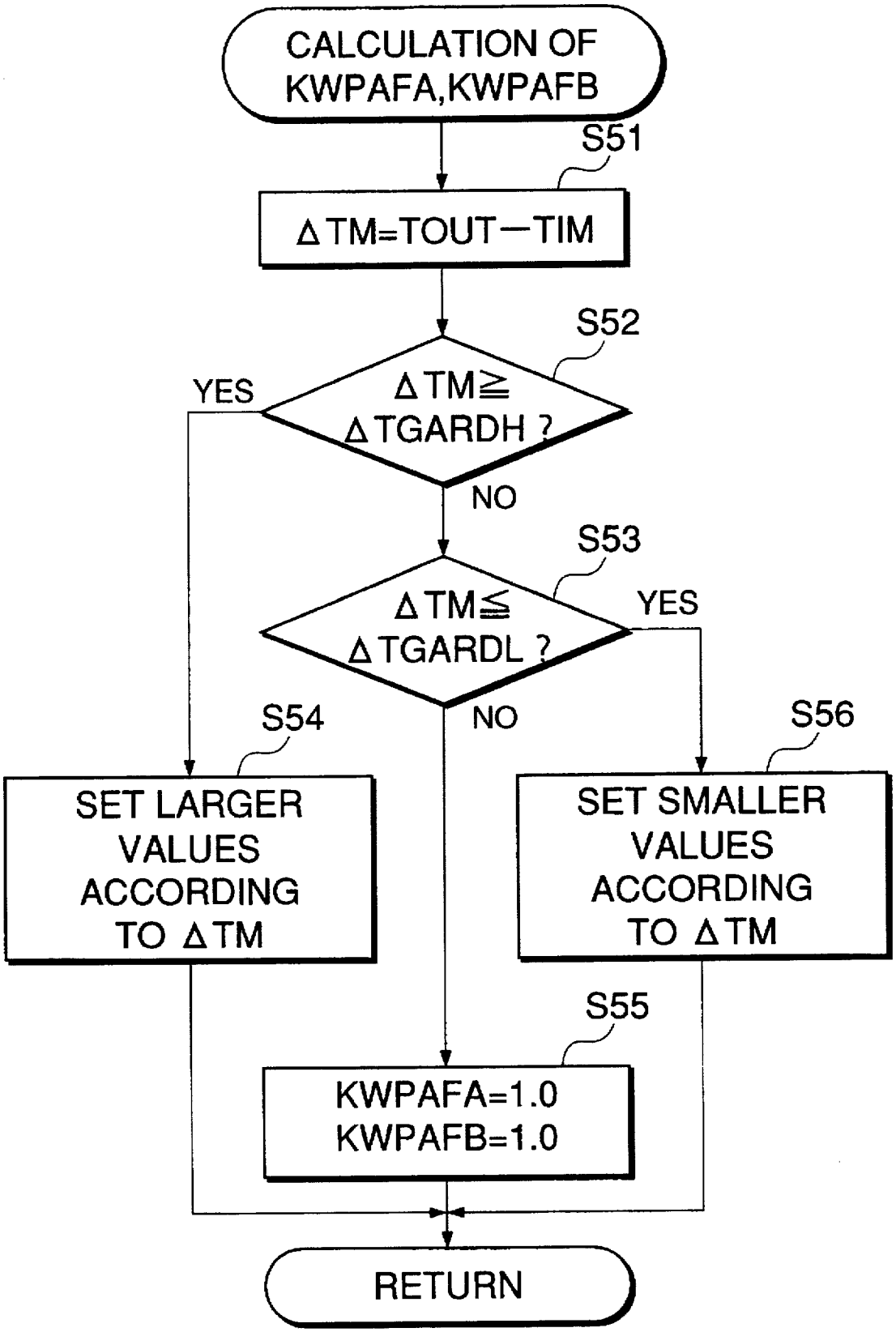
FIG. 9 a flowchart showing a subroutine for calculating the direct supply ratio correction coefficient KWPAFA and the carry-off ratio correction coefficient KWPAFB, which is executed by a fuel supply control system according to a second embodiment of the invention.

Further, in the present embodiment, at the step S22 of the FIG. 4 subroutine, the first direct supply ratio correction coefficient KWPAFA and the first carry-off ratio correction coefficient KWPAFB are calculated by executing a subroutine shown in FIG. 9 instead of the FIG. 5 subroutine. Except for the above points, the second embodiment is identical to the first embodiment.

Referring to FIG. 9, steps S51 to S56 are substantially identical to the steps S41 to S46 of the FIG. 7 subroutine for calculating the correction coefficients KWPAFSTA, KWPAFSTB applied when the engine is in the starting mode. More specifically, the difference ΔTM between the fuel injection amount TOUT and the basic fuel injection amount TIM is calculated at the step S51. If ΔTGARDL<ΔTM<ΔTGARDH holds, the correction coefficients KWPAFA and KWPAFB are both set to "1.0" at the step S55. If ΔTM≧ΔTGARDH holds, the correction coefficients KWPAFA and KWPAFB are set to larger values as the difference ΔTM increases at the step S54, whereas if ΔTM≦ΔTGARDL holds, the correction coefficients KWPAFA and KWPAFB are set to smaller values as the difference ΔTM decreases (i.e. the absolute value of the difference ΔTM increases) at the step S56. The setting of the coefficients KWPAFA and KWPAFB at the step S54 or S56 is carried out by retrieving respective tables set similarly to the FIG. 8A and FIG. 8B tables for the starting mode, respectively.

By thus setting the correction coefficients KWPAFA, KWPAFB, the direct supply ratio A and the carry-off ratio B can be set to proper values even if the air-fuel ratio of the mixture is set to an extremely rich value or an extremely lean value with respect to the stoichiometric air-fuel ratio, to thereby carry out accurate adherent fuel-dependent correction of the fuel injection amount irrespective of the air-fuel ratio of the mixture supplied to the engine.

In the second embodiment, the difference ΔTM is calculated by subtracting the basic fuel injection amount TIM from the fuel injection amount TOUT. However, this is not limitative, but the difference ΔTM may be calculated by the use of the following equation (11) or (12):

$$\Delta TM = TOUT - TIM \times KO2 \quad (11)$$

$$\Delta TM = TOUT - TIM \times KREF \quad (12)$$

where KO2 represents the air-fuel ratio correction coefficient which is set in response to the output from the O2 sensor in a feedback manner as described above for use in calculating the required fuel amount TCYL, and KREF a learned value of the air-fuel ratio correction coefficient KO2.

Although in the first embodiment described before, when the air-fuel ratio of the mixture is extremely rich or extremely lean, the correction coefficients KWPAFA and KWPAFB are determined by retrieving the KWPAFA and KWPAFB tables shown in FIGS. 6A and 6B, respectively, according to the desired air-fuel ratio KCMD, or by retrieving the KWPAFSTA and KWPAFSTB tables shown in FIGS. 8A and 8B, respectively, according to the difference ΔTS, this is not limitative, but the correction coefficients may be set, for example, to predetermined values larger than 1.0 when KCMD≧KCMDH or ΔTS≧ΔTGARDH holds, and to predetermined values smaller than 1.0 when KCMD≦KCMDL or ΔTS≦ΔTGARDL holds.

Further, although in the above described embodiments, the direct supply ratio A and the carry-off ratio B are both corrected, this is not limitative, but only one of them may be corrected.

Further, although in the above embodiments, as an adherent fuel-dependent correction parameter, the carry-off ratio B is used, this is not limitative, but a carry-off time constant T may be used instead of the carry-off ratio B. In this case, a correction coefficient corresponding to the carry-off ratio correction coefficient KWPAFB or KWPAFSTB by which the time constant T is multiplied is set to a smaller value as the air-fuel ratio of the mixture is smaller or richer, while when the air-fuel ratio of the mixture is equal to or close to the stoichiometric air-fuel ratio, the correction coefficient is set to a non-correction value (1.0). The adherent fuel-dependent correction of the fuel injection amount by the use of the carry-off time constant T is described in Japanese Patent Application No. 6-287264 filed by the present assignee.

Further, although in the above described embodiments the difference ΔTS or ΔTIM is calculated, this is not limitative, but the difference between the required fuel amount TCY(N) and the corrected value of the basic fuel injection amount TIS or TIM may be used, instead, for example.

Next, a third embodiment of the invention will be described with reference to FIGS. 10 to 15B. The hardware construction of this embodiment is identical to that of the first embodiment shown in FIG. 1, and hence detailed description thereof will be omitted.

Figure 10:
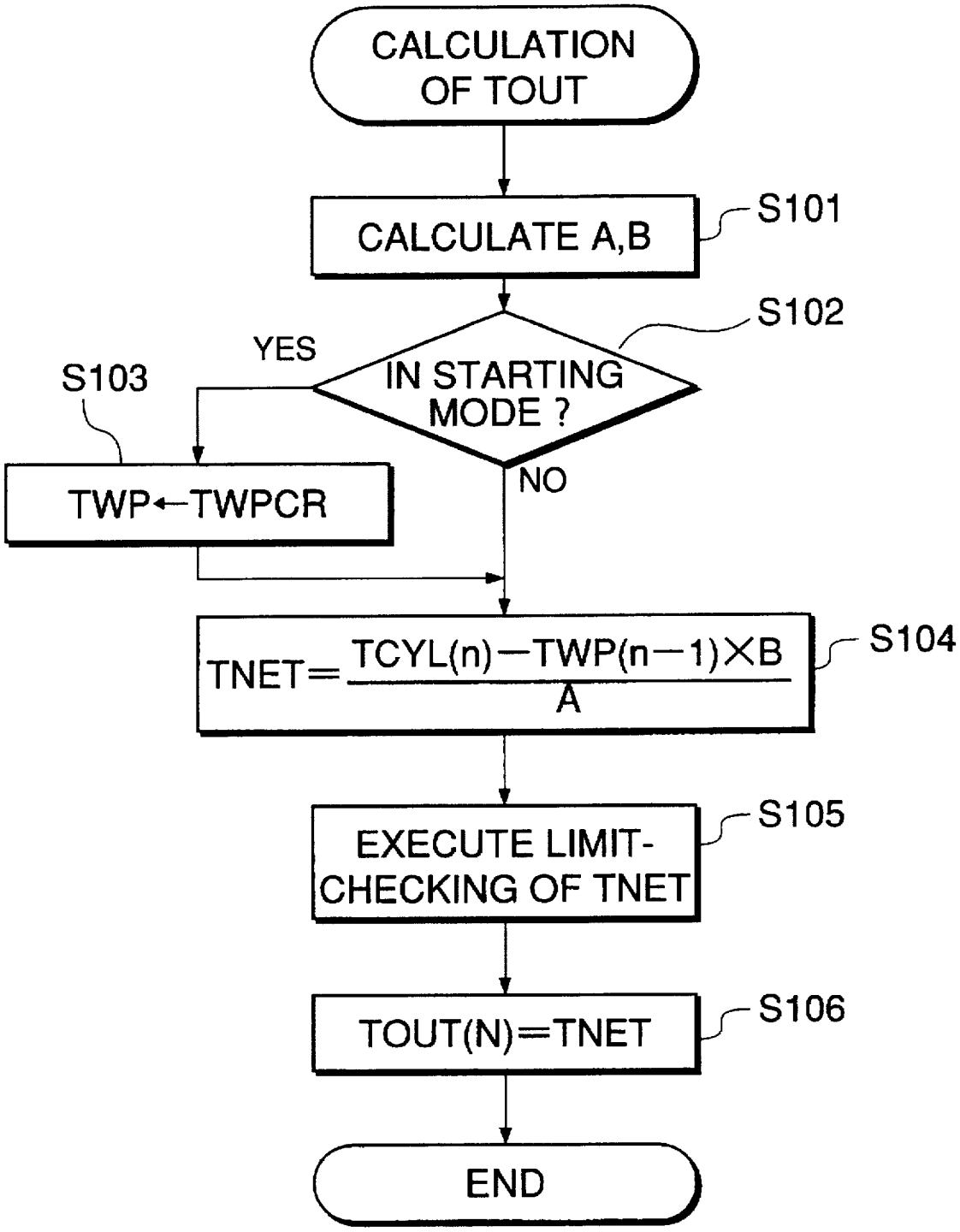
FIG. 10 is a flowchart showing a routine for calculating the fuel injection amount TOUT, which is executed by a fuel supply control system according to a third embodiment of the invention.

FIG. 10 shows a routine for calculating the fuel injection amount TOUT, which is executed by the CPU 5*b* of the ECU 5 in synchronism of generation of each TDC signal pulse.

First, at a step 101, the direct supply ratio A and the carry-off ratio B as adherent fuel-dependent correction parameters are calculated. Details of these calculations will be described hereinafter with reference to FIG. 11.

At the following step S102, it is determined whether or not the engine is in the starting mode (i.e. whether the engine is being cranked). If the engine is not in the starting mode, the program immediately proceeds to a step S104, whereas if the engine is in the starting mode, the adherent fuel amount TWP used in a calculation executed at the step S104 is set to an adherent fuel amount TWPCR set for the starting mode of the engine, referred to hereinafter, at a step S103, and then the program proceeds to the step S104.

Figure 12:
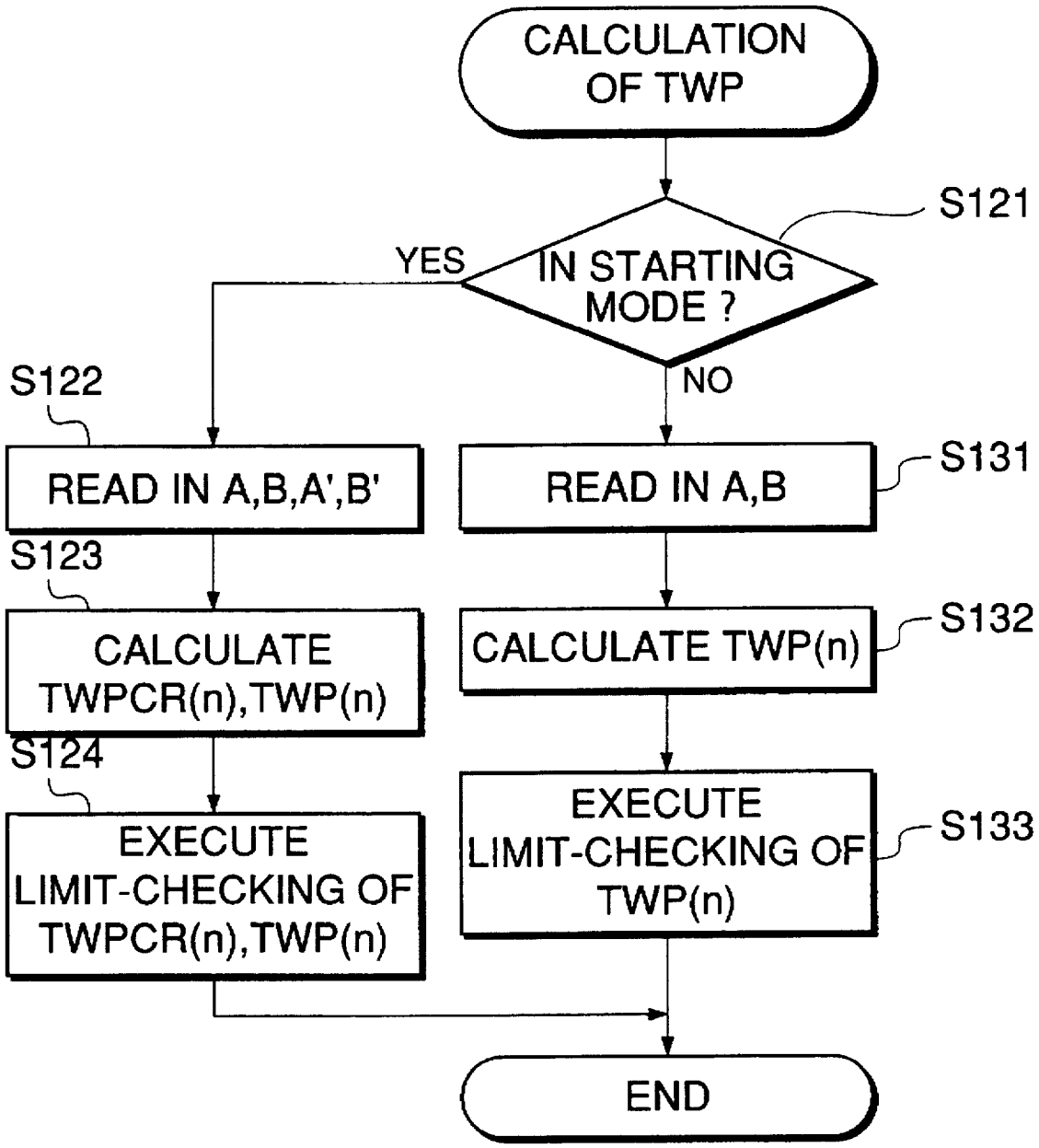
FIG. 12 is a flowchart showing a routine for calculating the adherent fuel amount TWP.

At the step S104, the net fuel injection amount TNET as an amount of fuel to be injected in the present loop is calculated by the following equation (13):

$$TNET=(TCYL(n)-B\times TWP(n-1))/A \quad (13)$$

where TCYL(n) represents the present value of the required fuel amount described with respect to the first embodiment, and TWP(n−1) represents the immediately preceding value of the adherent fuel amount, which is calculated in the present embodiment by executing a subroutine shown in FIG. 12.

At the following step S105, limit-checking of the net fuel injection amount TNET calculated at the step S104 is carried out. More specifically, if the calculated TNET value is a negative value, the net fuel injection amount TNET is set to "0", whereas if the calculated TNET value exceeds a predetermined upper limit value TNETLMTH, the net fuel injection amount TNET is set to the predetermined upper limit value TNETLMTH.

Then, the fuel injection amount TOUT(N) as the ultimate value is set to the net fuel injection amount TNET at the step S104, followed by terminating the program.

The subroutine executed at the step S101 of the FIG. 10 routine for calculating the direct supply ratio A and the carry-off ratio B will now be described with reference to FIG. 11.

First, at a step S111, it is determined whether or not the engine is in the starting mode, i.e. the engine is being cranked. This determination is carried out by determining whether or not the engine rotational speed NE is lower than a predetermined value NECR.

Figure 13:
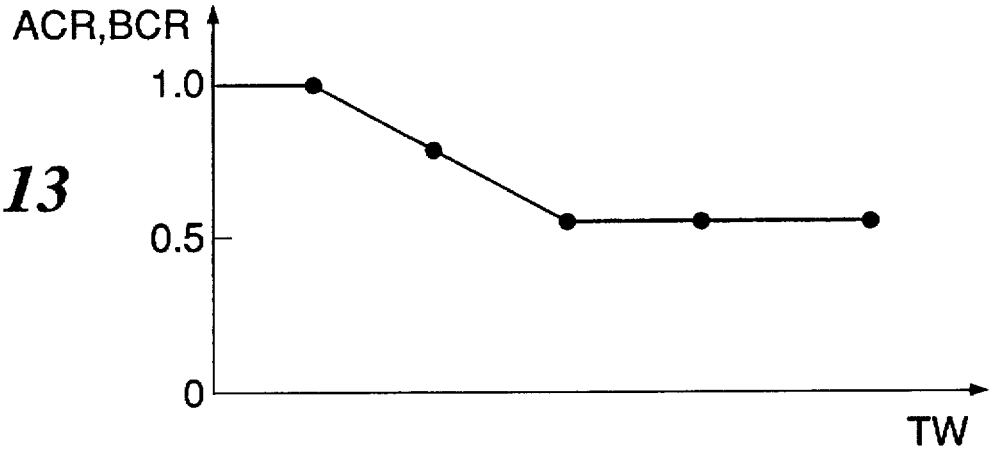
FIG. 13 shows a table for use in calculating a basic value ACR of the direct supply ratio for the starting mode of the engine and a basic value BCR of the carry-off ratio for the starting mode of the engine.

If the engine is in the starting mode, the program proceeds to a step S112, wherein a basic value ACR of the direct supply ratio A and a basic value BCR of the carry-off ratio B suitable for the starting mode of the engine are determined by retrieving an ACR/BCR table, which is set e.g. as shown in FIG. 13, according to the engine coolant temperature TW. Further, a basic value ATW of the direct supply ratio A and a basic value BTW of the carry-off ratio B for provisional calculation of the adherent fuel amount TWP are determined by retrieving an ATW table and a BTW table which are set e.g. as shown in FIGS. 15A and 15B, respectively, according to the engine coolant temperature TW.

The ACR/BCR table is set such that as the engine coolant temperature TW is higher, the ACR value and the BCR value decrease. As the ACR value and the BCR value are closer to 1.0, it means that there is a smaller amount of fuel adhering to the inner wall surface of the intake pipe. Therefore, the ACR/BCR table sets the degree of the adherent fuel-dependent correction of the fuel injection amount such that it is smaller as the engine coolant temperature TW is lower. Further, the table values of the ACR/BCR table are set larger (or closer to 1.0), which correspond to smaller degrees of the adherent fuel-dependent correction of the fuel injection amount, than the respective corresponding map values AMAP of the direct supply ratio A and the respective corresponding map values BMAP of the carry-off ratio B for the basic mode of the engine, which are determined by retrieving respective maps.

By using the adherent fuel-dependent correction parameters ACR, BCR thus determined for the starting mode of the engine, it is possible to carry out the adherent fuel-dependent correction of the fuel injection amount without degrading the startability of the engine even during starting of the engine.

Figure 15A:
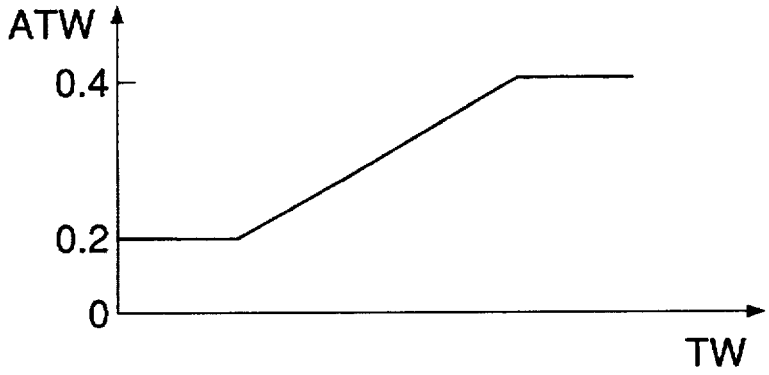
FIG. 15A shows an ATW table for use in determining the basic value ATW.
Figure 15B:
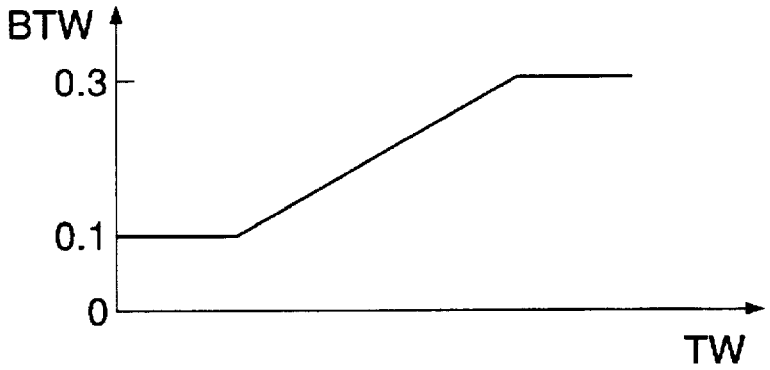
FIG. 15B shows a BTW table for use in determining the basic value BTW.

The ATW table and the BTW table are set as shown in FIGS. 15A and 15B, respectively, such that the ATW value and the BTW value increase as the engine coolant temperature TW is higher. The adherent fuel amount TWP calculated by the use of the basic values ATW and BTW is employed as an initial value or immediately preceding value of the adherent fuel amount TWP to be applied immediately after completion of the start of the engine, when the adherent fuel amount TWP is then calculated.

At the following step S113, various corrections are carried out on the adherent fuel-dependent correction parameters ACR, BCR for the starting mode of the engine. More specifically, correction coefficients are calculated based on the engine rotational speed NE, the atmospheric pressure PA, the intake air temperature TA, etc., and the retrieved basic value ACR of the direct supply ratio A and the retrieved basic value BCR of the carry-off ratio B are multiplied by these correction coefficients to obtain a corrected basic value ACRM of the direct supply ratio A and a corrected basic value BCRM of the carry-off ratio B. Then, the ACRM value and the BCRM value are set to the direct supply ratio A and the carry-off ratio B, respectively, and at the same time the basic values ATW and BTW for provisional calculation are set to a provisional direct supply ratio A' and a provisional carry-off ratio B' at the step S114, respectively, followed by terminating the program.

On the other hand, if it is determined at the step S111 that the engine is not in the starting mode, i.e. the engine is in the basic mode, a map value AMAP of the direct supply ratio A and a map value BMAP of the carry-off ratio B are calculated by retrieving respective maps according to the engine rotational speed NE and the intake pipe absolute pressure PBA at a step S115. Then, a transitional processing is carried out at a step S116. According to the transitional processing, if the differences between the ACR value and the BCR value obtained immediately before the engine enters the basic mode and the map values AMAP and BMAP determined at the step S115 are large, the values of the adherent fuel-dependent correction parameters to be applied as the basic values of the direct supply ratio and the carry-off ratio are progressively shifted from the ACR value and the BCR value to the map values AMAP and BMAP.

This transitional processing makes it possible to prevent sudden changes in the adherent fuel-dependent correction parameters and hence undesired fluctuations in the engine rotational speed NE.

At the following step S117, the AMAP value and the BMAP value after the transitional processing are multiplied by the correction coefficients determined based on the engine coolant temperature TW, the intake air temperature TA, the atmospheric pressure PA, etc. to obtain corrected map values AMAPM, BMAPM. These map values AMAPM and BMAPM are set to the direct supply ratio A and the carry-off ratio B, respectively, at a step S118, followed by terminating the program.

FIG. 12 shows a subroutine for calculating the adherent fuel amount TWP.

First, at a step S121, it is determined whether or not the engine is in the starting mode. If the engine is in the starting mode, the newest values of the direct supply ratio A and the provisional direct supply ratio A' and the carry-off ratio B and the provisional carry-off ratio B' calculated at the step S114 of the FIG. 11 subroutine are read in at a step S122, and an adherent fuel amount TWPCR(N) for the starting mode and an adherent fuel amount TWP(N) for the basic mode are calculated by the use of the following equations (14) and (15):

$$TWPCR(n)=(1-A)\times TOUT(n)+(1-B)\times TWPCR(n-1) \quad (14)$$

$$TWP(n)=(1-A')\times TOUT(n)+(1-B')\times TWP(n-1) \quad (15)$$

where TWPCR(n−1) and TWP(n−1) represent the immediately preceding values of the adherent fuel amounts TWPCR and TWP, and the first term on the right side of each equation represents an amount of fuel newly attached to the inner wall surface of the intake pipe by an injection carried out just before the present loop, and the second term on the right side of the same represents a remaining amount of the adherent fuel from which a portion of the adherent fuel has been carried off.

At the following step S124, limit-checking of the adherent fuel amounts TWPCR(n) and TWP(n) thus calculated is carried out, followed by terminating the program.

Figure 11:
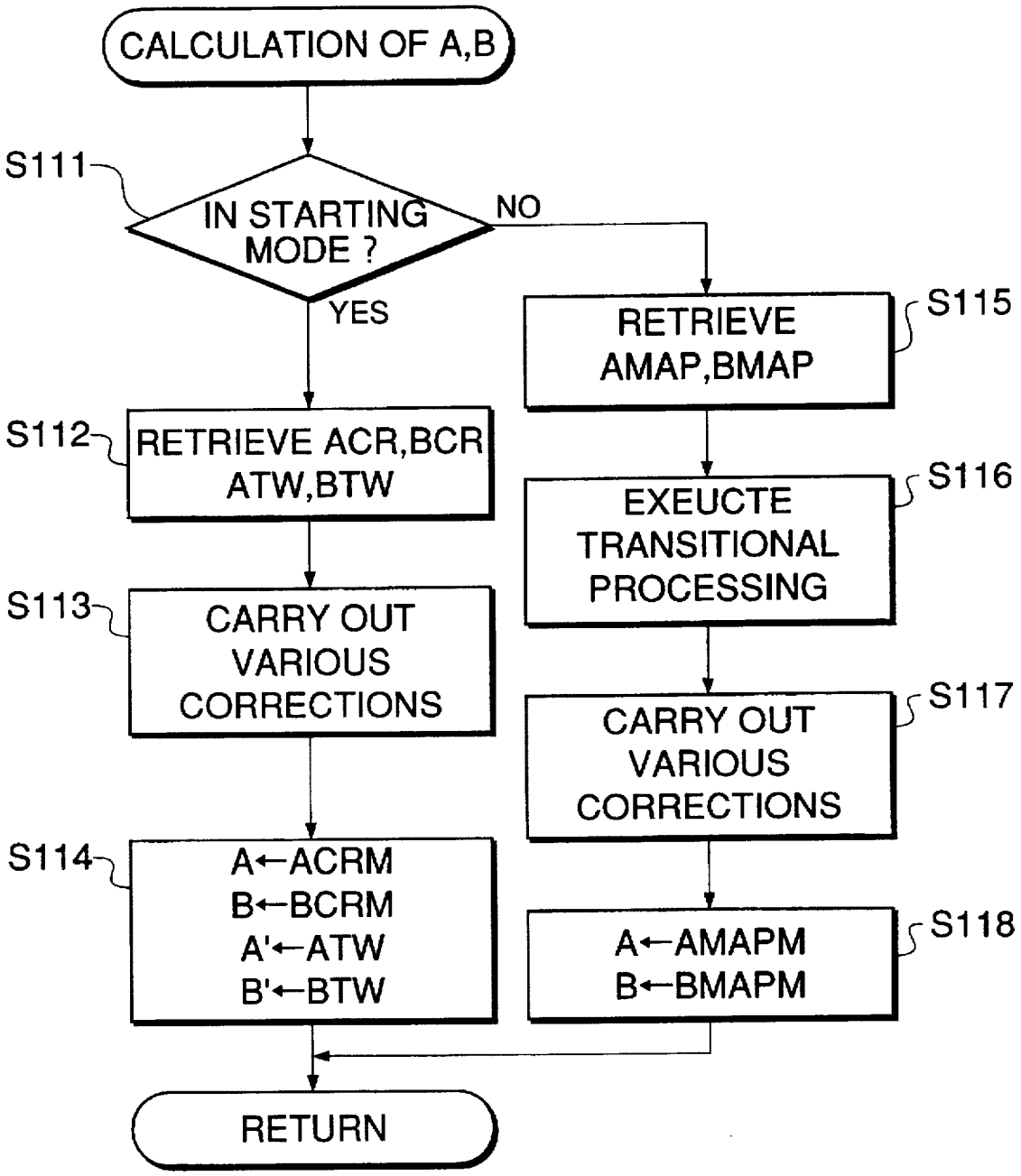
FIG. 11 is a flowchart showing a subroutine of calculating the direct supply ratio A and the carry-off ratio B.

On the other hand, if it is determined at the step S121 that the engine is not in the starting mode, the newest values of the direct supply ratio A and the carry-off ratio B calculated at the step S118 of the FIG. 11 routine are read in at a step S131, and then the adherent fuel amount TWP(N) is calculated by the use of the following equation (16) (step S132):

$$TWP(n)=(1-A)\times TOUT(n)+(1-B)\times TWP(n-1) \quad (16)$$

Immediately after the engine enters the basic mode, as the term TWP(n−1) on the right side is applied a TWP value calculated in the starting mode by the use of the provisional direct supply ratio A' and the provisional carry-off ratio B' based on the ATW and BTW values.

Then, at a step S133, limit-checking of the adherent fuel amount TWP(n) thus calculated is carried out, followed by terminating the program.

Figure 14:
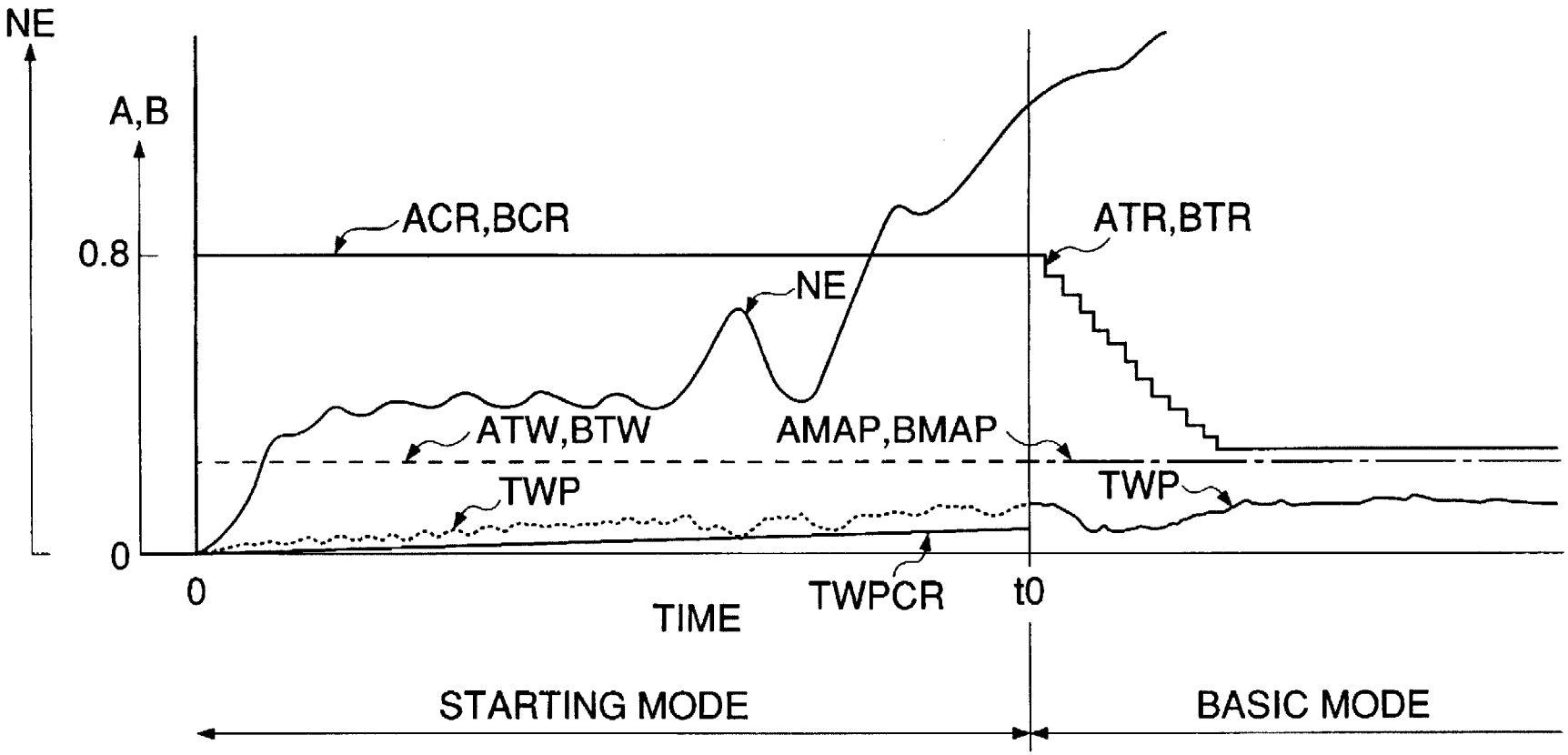
FIG. 14 a diagram showing the basic values ACR, BCR, a basic value ATW of the direct supply ratio and a basic value BTW of the carry-off supply ratio for provisional calculation, as well as changes in a basic value ATR of the direct supply ratio and a basic value BCR of the carry-off supply ratio calculated during transitional processing, the adherent fuel amount TWP, and the engine rotational speed NE.

FIG. 14 shows an example of changes in the direct supply ratio A, the carry-off ratio B, the adherent fuel amount TWP, and the engine rotational speed NE, which occur when the engine is started and subsequently enters the basic mode. In this example, the basic value ACR of the direct supply ratio A and the basic value BCR of the carry-off ratio B for the starting mode are set to 0.8, and hence the adherent fuel amount TWPCR for the starting mode calculated by the use of these parameters progressively increases with the lapse of time. This makes it possible to carry out the adherent fuel-dependent correction of the fuel injection amount to such an extent that the startability of the engine is not degraded. Further, during the starting mode, the adherent fuel amount TWP is calculated by the use of the basic value ATW of the direct supply ratio A and the basic value BTW of the carry-off ratio B for provisional calculation. When the engine rotational speed NE rises and the engine enters the basic mode at a time point t0, the initial value of the adherent fuel amount TWP to be applied in the basic mode is set to a final value of the adherent fuel amount TWP calculated in the starting mode by the use of the basic value ATW of the direct supply ratio A and the basic value BTW of the carry-off ratio B for provisional calculation. At the same time, the direct supply ratio A and the carry-off ratio B are determined by the transitional processing (in the figure, the basic values of the direct supply ratio A and the carry-off ratio B calculated during execution of the transitional processing are indicated by ATR and BTR, respectively), whereby the basic values of the direct supply ratio A and the carry-off ratio B are progressively shifted from the ACR value and the BCR value to the AMAP value and the BMAP value.

As described above, according to the present embodiment, the basic value ACR of the direct supply ratio A and the basic value BCR of the carry-off ratio B for the starting mode are determined according to the engine coolant temperature TW even during the start of the engine. These basic values ACR, BCR are set to values larger than the map values to be retrieved in the basic mode so as to reduce the degree of the adherent fuel-dependent correction, and moreover set to such values as will cause a smaller degree of the adherent fuel-dependent correction of the fuel injection amount as the engine coolant temperature TW is lower. Therefore, the startability of the engine is not degraded even when the engine is started in cold weather.

Further, upon a transition of the engine from the starting mode to the basic mode, the adherent fuel amount TWP is calculated based on a value (immediately 5 preceding value) thereof calculated by the use of the basic value ATW of the provisional direct supply ratio A' and the basic value BTW of the provisional carry-off ratio B' for provisional calculation in the immediately preceding loop, which are set to values smaller than the basic value ACR of the direct supply ratio A and the basic value BCR of the carry-off ratio B for the starting mode (and approximately equal to map values AMAP and BMAP to be used after the start of the engine). Therefore, it is possible to properly set an initial value of the adherent fuel amount TWP upon the transition of the engine, thereby enhancing the accuracy of the adherent fuel-dependent correction of the fuel injection amount when the engine has entered the basic mode.

Further, the transitional processing carried out immediately after the engine shifts from the starting mode to the basic mode makes it possible to prevent undesired fluctuations in the fuel supply amount caused by sudden changes in the degree of the adherent fuel-dependent correction of the fuel injection amount.

Although in the third embodiment described above, the basic value ACR of the direct supply ratio A and the basic value BCR of the carry-off ratio B for the starting mode, and the basic value ATW of the provisional direct supply ratio A' and the basic value BTW of the carry-off ratio B for the provisional calculation are determined according to the engine coolant temperature TW, this is not limitative, but they may be determined according to the intake air temperature TA or the engine oil temperature, e.g. by retrieving tables set similarly to those shown in FIG. 13 or FIGS. 15A and 15B.

What is claimed is:

1. A fuel supply control system for an internal combustion engine having an intake passage having an inner wall surface, at least one fuel injection valve, and at least one combustion chamber, comprising:

required fuel amount-calculating means for calculating a required amount of fuel to be supplied into said at least one combustion chamber of said engine, based on operating conditions of said engine;

starting completion-determining means for determining whether starting of said engine has been completed;

first parameter-calculating means for calculating a first parameter as a parameter representative of fuel adherence characteristics of said inner wall surface of said intake passage, based on operating conditions of said engine before completion of starting of said engine;

second parameter-calculating means for calculating a second parameter as said parameter representative of said fuel adherence characteristics, based on operating conditions of said engine after completion of starting of said engine;

fuel amount-calculating means for calculating a first amount of fuel which is injected by said at least one fuel injection valve and directly drawn into said at least one combustion chamber and a second amount of fuel which is carried off from said inner wall surface of said intake passage into said at least one combustion chamber, based on said first parameter or said second parameter;

fuel injection amount-calculating means for correcting said required amount of fuel calculated by said required fuel amount-calculating means, based on said first amount of fuel and said second amount of fuel to calculate an amount of fuel to be injected by said at least one fuel injection valve;

driving means for driving said at least one fuel injection valve to inject fuel in said amount of fuel calculated by said fuel injection amount-calculating means into said intake passage; and third parameter-calculating means for calculating a third parameter as said parameter representative of said fuel adherence characteristics for use in the calculation by said fuel-amount calculating means immediately after completion of starting of said engine, based on operating conditions of said engine detected before completion of starting of said engine.

2. A fuel supply control system according to claim 1, including transitional control means for progressively shifting said parameter representative of said fuel adherence characteristics from said first parameter calculated by said first parameter-calculating means to said second parameter calculated by said second parameter-calculating means immediately after completion of starting of said engine.

3. A fuel supply control system according to claim 1 or 2 wherein said first, second, and third parameters calculated by said first parameter-calculating means, said second parameter-calculating means and said third parameter-calculating means each have a value related to an amount of fuel adhering to said inner wall surface of said intake passage.

4. A fuel supply control system according to claim 1 or 2, wherein said first parameter is calculated by said first parameter-calculating means to such a value as cause a smaller degree of said correction of said required amount of fuel by said fuel amount-calculating means than values to which are calculated said second and third parameters by said second parameter-calculating means and said third parameter-calculating means.

5. A fuel supply control system for an internal combustion engine having an intake passage having an inner wall surface, at least one fuel injection valve, and at least one combustion chamber, comprising:

required fuel amount-calculating means for calculating a required amount of fuel to be supplied into said at least one combustion chamber of said engine, based on operating conditions of said engine;

starting completion-determining means for determining whether starting of said engine has been completed;

first parameter-calculating means for calculating a first parameter as a parameter representative of fuel adherence characteristics of said inner wall surface of said intake passage, based on operating conditions of said engine before completion of starting of said engine;

second parameter-calculating means for calculating a second parameter as said parameter representative of said fuel adherence characteristics, based on operating conditions of said engine after completion of starting of said engine;

fuel amount-calculating means for calculating a first amount of fuel which is injected by said at least one fuel injection valve and directly dram into said at least one combustion chamber and a second amount of fuel which is carried off from said inner wall surface of said intake passage into said at least one combustion chamber, based on said first parameter or said second parameter;

fuel injection amount-calculating means for correcting said required amount of fuel calculated by said required fuel amount-calculating means, based on said first amount of fuel and said second amount of fuel to calculate an amount of fuel to be injected by said at least one fuel injection valve;

said first parameter being calculated by said first parameter-calculating means to such a value as to cause a smaller degree of said correction of said required amount of fuel by said fuel injection amount-calculating means than a value which is calculated as said second parameter by said second parameter-calculating means, wherein said first parameter is set to a value such that a degree of correction of said required amount of fuel is smaller as an engine coolant temperature is lower; and driving means for driving said at least one fuel injection valve to inject fuel in said amount of fuel calculated by said fuel injection amount-calculating means into said intake passage.

* * * * *